US005342725A

United States Patent [19]

Kato

[11] Patent Number: 5,342,725

[45] Date of Patent: Aug. 30, 1994

[54] LIQUID DEVELOPER FOR ELECTROSTATIC PHOTOGRAPHY

[75] Inventor: Eiichi Kato, Shizuoka, Japan

[73] Assignee: Fuji Photo Film Co., Ltd., Kanagawa, Japan

[21] Appl. No.: 79,557

[22] Filed: Jun. 22, 1993

[30] Foreign Application Priority Data

Jun. 23, 1992 [JP] Japan ..... 4-187327
Jun. 25, 1992 [JP] Japan ..... 4-190172

[51] Int. Cl.[5] ..... G03G 9/13; G03G 9/135
[52] U.S. Cl. ..... 430/115; 430/114
[58] Field of Search ..... 430/114, 115

[56] References Cited

U.S. PATENT DOCUMENTS 5,041,352 8/1991 Kato et al. ..... 430/114
5,049,468 9/1991 Kato et al. ..... 430/115
5,073,470 12/1991 Kato et al. ..... 430/114
5,073,471 12/1991 Kato et al. ..... 430/114
5,114,822 5/1992 Kato et al. ..... 430/114
5,141,835 8/1992 Kato et al. ..... 430/115

FOREIGN PATENT DOCUMENTS 0317663 1/1991 Japan .
0318863 1/1991 Japan .
3123362 5/1991 Japan .
3123363 5/1991 Japan .
3148670 6/1991 Japan .

*Primary Examiner*—Roland Martin
*Attorney, Agent, or Firm*—Sughrue, Mion, Zinn, Macpeak & Seas

[57] ABSTRACT

A liquid developer for electrostatic photography comprising at least resin grains dispersed in a non-aqueous solvent having an electric resistance of at least $10^9$ Ωcm and a dielectric constant of not higher than 3.5, wherein the dispersed resin grains are polymer resin grains obtained by polymerizing a solution containing (1) at least one monofunctional monomer (A) which is soluble in the non-aqueous solvent but becomes insoluble therein by being polymerized, (2) at least one monofunctional macromonomer (MA) having a number average molecular weight of not more than $1\times10^4$ and having a polymerizable double bond or at least one oligomer (B) having a number average molecular weight of not more than $1\times10^4$ and having at least one polar group selected from a carboxy group, a sulfo group, a hydroxy group, a formyl group, an amino group, a phosphono group and

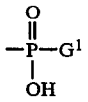

(3) at least one polyfunctional monomer (D) having at least two polymerizable functional groups which are copolymerizable with the monofunctional monomer (A), and (4) at least one dispersion-stabilizing resin (P) soluble in the non-aqueous solvent. The liquid developer of the present invention is excellent in dispersibility and redispersibility of resin grains, and resistivity, and provides a master plate for offset printing having high printing durability.

11 Claims, No Drawings

LIQUID DEVELOPER FOR ELECTROSTATIC PHOTOGRAPHY

FIELD OF THE INVENTION

The present invention relates to a liquid developer for electrostatic photography, which comprises resin grains dispersed in a liquid carrier having an electric resistance of at least $10^9$ Ωcm and a dielectric constant of not higher than 3.5, and more particularly to an electrophotographic liquid developer excellent in redispersibility of resin grains and resistivity to a treating solution.

BACKGROUND OF THE INVENTION

In general, a liquid developer for electrophotography is prepared by dispersing an inorganic or organic pigment or dye such as carbon black, nigrosine, phthalocyanine blue, etc., a natural or synthetic resin such as an alkyd resin, an acrylic resin, rosine, synthetic rubber, etc., in a .liquid having a high electric insulating property and. a low dielectric constant, such as a petroleum aliphatic hydrocarbon, etc., and further adding a polarity-controlling agent such as a metal soap, lecithin, linseed oil, a higher fatty acid, a vinyl pyrrolidone-containing polymer, etc., to the resulting dispersion.

In such a developer, the resin is dispersed in the form of insoluble latex grains having a grain size of from several nm to several hundred nm, and it is important for the latex grains that the grains have uniform grain diameter and do not aggregate, precipitate or accumulate during storage thereof. If such requirements are not satisfied, there may be problems in causing poor reproduction of the images formed, stains of non-image portions or malfunctions of the developing machine, such as clogging of a liquid feed pump, etc.

For overcoming the above problems, a dispersion polymerization method in a non-aqueous system for obtaining insoluble latex grains having fine grain diameter and good monodispersibility has been proposed and has further been studied. For example, an improved method using a soluble dispersion-stabilizing resin is disclosed in U.S. Pat. Nos. 3,990,980, 4,618,557, 5,006,441, 5,100,751, 5,112,716 and JP-A-1-257969 (the term "JP-A" as used herein means an "unexamined published Japanese patent application"), and a method for modifying the surface of latex grains by using a compound having a physical and chemical interaction with the monomer to be insolubilized is disclosed in U.S. Pat. Nos. 4,840,865, 4,842,975, 4,977,055, 5,041,352, 5,049,468, 5,055,369, 5,073,470 and 5,073,471 and JPA-3-13964, JP-A-3-17663, JP-A-3-123362 and JP-A-3-18863. These methods are described as being useful for improving degree of grain dispersion, grain diameter, redispersibility and storage stability.

On the other hand, studies for putting practical use or development of direct lithographic printing system using electrophotographic technique has recently been made actively. The system comprises forming a toner image on the surface of an electrophotographic light-sensitive material by electrophotographic system, and treating the resulting light-sensitive material to render the non-image portion thereof hydrophilic thereby producing a lithographic printing master plate.

Typical methods for rendering the non-image portion hydrophilic include a method for dissolving out the non-image area with a treating solution and utilizing hydrophilicity of the surface of the support under the electrophotographic light-sensitive layer, and a method for modifying an oleophilic property of the surface in the non-image portion of the light-sensitive layer to a hydrophilic property.

Recently, as an improved latter method for conventional oil-desensitization treatment of photoconductive zinc oxide in the light-sensitive layer, JP-A-62-21669, JP-A-l-191157 and JP-A-2-15277 disclose that hydrophilicity of the non-image portion can be increased by converting the binder resin used in the light-sensitive layer to a hydrophilic resin. In this system, it is important that the toner image portion remains unchanged upon treatment with the treating solution. Such a property is hereinafter referred to "resistivity" to the treating solution.

When a conventional liquid developer containing insoluble resin grains having good redispersibility is used in the above-described electrophotographic plate-making system and the non-image portion is sufficiently rendered hydrophilic, the toner does not show sufficient resistivity thereby sometimes causing loss of image portions. Such problems occur, in particular, in toner portions having small areas such as fine lines and letters or dot areas, and the quality of prints obtained from such a printing plate is deteriorated.

On the other hand, insoluble latex grains having high resistance to the treating solution, for example, styrene type latexes, possess sufficient resistivity, but these resins have low charge stability and redispersibility as toner grains and also provide compiicated problems in apparatus since these resins require a high temperature and long time fixing procedure due to poor fixing property of the toner grains.

SUMMARY OF THE INVENTION

The present invention has been made for solving the above-described problems inherent to conventional electrophotographic liquid developers.

An object of the present invention is to provide a liquid developer excellent in dispersion stability, redispersibility, fixing property and resistivity to the treating solution for hydrophilization in an electrophotomechanical system.

Another object of the present invention is to provide a liquid developer capable of forming an offset printing master plate having excellent reproducibility of the duplicated image to the original by electrophotography.

Still another object of the present invention is to provide a liquid developer capable of forming an offset printing master plate having excellent receptivity for printing ink and printing durability by electrophotography.

A further object of the present invention is to provide a liquid developer capable of being used for any liquid developer-using systems such as ink jet recording, cathode ray tube recording, and recording by pressure variation or electrostatic variation.

Other objects of the present invention will become apparent from the following description and examples.

The above-described objects of the present invention have been attained by a liquid developer for electrostatic photography comprising at least resin grains dispersed in a non-aqueous solvent having an electric resistance of at least $10^9$ Ωcm and a dielectric constant of not higher than 3.5, wherein the dispersed resin grains are polymer resin grains obtained by polymerizing a solution containing (1) at least one monofunctional monomer (A) which is soluble in the non-aqueous solvent but becomes insoluble therein by being polymerized, (2) at least one monofunctional macromonomer (MA) having a number average molecular weight of not more than $1\times10^4$ and having a polymerizable double bond group represented by the general formula (II) shown below bonded to only one terminal of the main chain of a polymer composed of a repeating unit represented by the general formula (I) shown below, or at least one oligomer (B) having a number average molecular weight of not more than $1\times10^4$ and having at least one polar group selected from a carboxy group, a sulfo group, a hydroxy group, a formyl group, an amino group, a phosphono group and

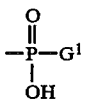

(wherein $G^1$ represents a hydrocarbon group or $—OG^2$ (wherein $G^2$ represents a hydrocarbon group) bonded to only one terminal of the main chain of a polymer composed of a repeating unit represented by the general formula (I) shown below, (3) at least one polyfunctional monomer (D) having at least two polymerizable functional groups which are copolymerizable with the monofunctional monomer (A), and (4) at least one dispersion-stabilizing resin (P) soluble in the non-aqueous solvent, which is a polymer containing a repeating unit represented by the general formula (III) shown below and the main chain of the polymer is partially cross-linked.

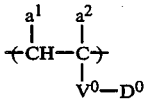

(I)

wherein $V^0$ represents —COO—, —OCO—, $-(CH_2)_r-COO—$, $-(CH_2)_r-OCO—$, —O—, $—SO_2—$, —CONHCOO—, CONHCONH—,

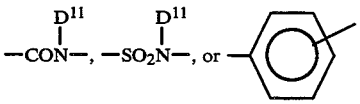

(wherein $D^{11}$ represents a hydrogen atom or a hydrocarbon group having from i to 22 carbon atoms; and r represents an integer of from i to 4); $a^1$ and $a^2$ which may be the same or different, each represents a hydrogen atom, a halogen atom, a cyano group, a hydrocarbon group, $—COO—D^{12}$, or $—COO—D^{12}$ bonded via a hydrocarbon group (wherein $D^{12}$ represents a hydrogen atom or a hydrocarbon group); and $D^O$ represents a hydrocarbon group having from 1 to 22 carbon atoms or a substituent selected from the substituents represented by the following. general formula (IV):

$$—(A^1—B^1)_m(A^2—B^2)_n—D^{21} \quad (IV)$$

wherein $D^{21}$ represents a hydrogen atom or a hydrocarbon group having from 1 to 22 carbon atoms; $B^1$ and $B^2$, which may be the same different, each represents —O—, —CO—, $—CO_2—$, —OCO—, $—SO_2—$,

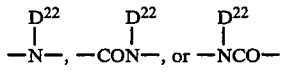

(wherein $D^{22}$ has the same meaning as $D^{21}$ defined above ); $A^1$ and $A^2$, which may be the same or different, each represents a hydrocarbon group having from 1 to 18 carbon atoms which may be substituted and which may contain an intervening group represented by the following formula in the main chain of the hydrocarbon group;

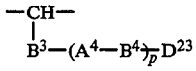

(wherein $B^3$ and $B^4$ which may be the same or different each has the same meaning as $B^1$ and B2; $A^4$ represents a hydrocarbon group having from 1 to 18 carbon atoms; and $D^{23}$ has the same meaning as $D^{21}$ defined above); m, n and p, which may be the same or different, each represents an integer of from 0 to 4, provided that m, n and p cannot be 0 at the same time;

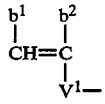

(II)

wherein $V^1$ has the same meaning as $V^0$ defined in the general formula (I); and $b^1$ and $b^2$, which may be the same or different, each has the same meaning as $a^1$ or $a^2$ defined in the general formula (I);

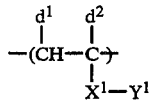

(III)

wherein $X^1$ represents —CO0—, —OCO—, $—CH_2OCO—$, $—CH_2COO—$, —O— or $—SO_2—$; $y^1$ represents an aliphatic group having from 6 to 32 carbon atoms; and $d^1$ and $d^2$, which may be the same or different, each represents a hydrogen atom, a halogen atom, a cyano group, a hydrocarbon group having from 1 to 8 carbon atoms, $—COO—Z^1$ or $—COO—Z^1$ bonded via a hydrocarbon group having from 1 to 8 carbon atoms (wherein $Z^1$ represents a hydrocarbon group having from 1 to 22 carbon atoms).

DETAILED DESCRIPTION OF THE INVENTION

Preferably, the polymer as dispersion-stabilizing resin (P) according to the present invention contains at least one polar group selected from $—PO_3H_2$, $—SO_3H$, —COOH,

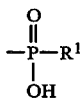

(wherein $R^1$ represents a hydrocarbon group or $—OR^2$ (wherein $R^2$ represents a hydrocarbon group), —OH, a formyl group,

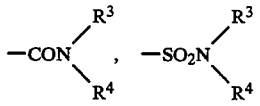

(wherein $R^3$ and $R^4$ each represents a hydrogen atom or a hydrocarbon group), a cyclic acid anhydride-containing group and an amino group, at one terminal of the main chain of the polymer.

More preferably, the polymer as dispersionstabilizing resin (P) contains a polymerizable functional group which is copolymerizable with the monomer (A), at one terminal of the main chain of the polymer.

Now, the liquid developer of the present invention will be described in detail below.

As the liquid carrier for the liquid developer of the present invention having an electric resistance of at least $10^9$ Ωcm and a dielectric constant of not higher than 3.5, straight chain or branched aliphatic hydrocarbons, alicyclic hydrocarbons, aromatic hydrocarbons, and halogen-substituted derivatives thereof can be used. Examples of liquid carrier include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The non-aqueous dispersed resin grains (hereinafter often referred to as "dispersed resin grains" or "latex grains") which are the most important constituting element in the present invention are resin grains produced by polymerizing (so-called polymerization granulation method), in a non-aqueous solvent, at least one monofunctional monomer (A), at least one monofunctional macromonomer (MA) or at least one oligomer (B), and at least one polyfunctional monomer (D), in the presence of a dispersion-stabilizing resin (P) soluble in the non-aqueous solvent which is a polymer having a partially crosslinked polymer chain.

Preferably, the polymer as dispersion-stabilizing resin (P) contains at least one polar group selected from the specific groups described above at one terminal of the polymer main chain.

More preferably, the polymer as dispersionstabilizing resin (P) contains a polymerizable functional group which is copolymerizable with the monomer (A) at one terminal of the polymer main chain.

As the non-aqueous solvent for use in the present invention, any solvents miscible with the above-described liquid carrier for the liquid developer for electrostatic photography can be basically used in the present invention.

That is, the non-aqueous solvent used in the production of the dispersed resin grains may be any solvent miscible with the above-described liquid carrier, and preferably includes straight chain or branched aliphatic hydrocarbons, alicyclic hydrocarbons, aromatic hydrocarbons, and halogen-substituted derivatives thereof.

Specific examples thereof are hexane, octane, isooctane, decane, isodecane, decalin, nonane, dodecane, isododecane, Isopar E, Isopar G, Isopar H, Isopar L, Shellsol 70, Shellsol 71, Amsco OMS, and Amsco 460 Solvent. These solvents may be used singly or as a combination thereof.

Other solvents can be used together with the above-described organic solvents for the production of the non-aqueous dispersed resin grains, and examples thereof include alcohols (e.g., methanol, ethanol, propyl alcohol, butyl alcohol, and fluorinated alcohols), ketones (e.g., acetone, methyl ethyl ketone, and cyclohexanone), carboxylic acid esters (e.g., methyl acetate, ethyl acetate, propyl acetate, butyl acetate, methyl propionate, and ethyl propionate), ethers (e.g., diethyl ether, dipropyl ether, tetrahydrofuran, and dioxane), and halogenated hydrocarbons (e.g., methylene dichloride, chloroform, carbon tetrachloride, dichloroethane, and methylchloroform).

It is preferred that the non-aqueous solvents which are used as a mixture thereof are distilled off by heating or under a reduced pressure after completion of the polymerization granulation. However, even when the solvent is brought in the liquid developer as a latex grain dispersion, the solvent gives no problem if the liquid electric resistance of the liquid developer is in the range of satisfying the condition of at least $10^9$Ωcm.

In general, it is preferred that the same solvent as the liquid carrier is used in the step of forming the resin dispersion and, such solvents include straight chain or branched aliphatic hydrocarbons, alicyclic hydrocarbons, aromatic hydrocarbons, halogenated hydrocarbons, etc., as described above.

The monofunctional monomer (A) used in the present invention may be a monofunctional monomer which is soluble in the non-aqueous solvent but becomes insoluble by being polymerized.

Specific examples of the monomer (A) include monomers represented by the following formula (V);

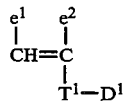

(V)

wherein $T^1$ represents —COO—, —OCO—, —CH2OCO—, —$CH_2$COO—, —O—, —CONHCOO—, —CONHOCO—, —$SO_2$N—,

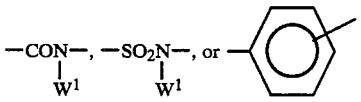

(wherein $W^1$ represents a hydrogen atom or an aliphatic group having from 1 to 8 carbon atoms which may be substituted (e.g., methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl, and 3-methoxypropyl).

$D^1$ in the above general formula (V) represents a hydrogen atom or an aliphatic group having from 1 to 6 carbon atoms which may be substituted (e.g., methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxypropyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridiylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, and dichlorohexyl).

In the above general formula (V), $e^1$ and $e^2$, which may be the same or different, each has the same meaning as $a^1$ or $a^2$ in the general formula (I).

Specific examples of the monofunctional monomer (A) include vinyl esters or allyl esters of an aliphatic carboxylic acid having from 1 to 6 carbon atoms (e.g., acetic acid, propionic acid, butyric acid, monochloroacetic acid, and trifluoropropionic acid); alkyl esters or alkyl amides (the alkyl having from 1 to 4 carbon atoms, which may be substituted) of an unsaturated carboxylic acid such as acrylic acid, methacrylic acid, crotonic acid, itaconic acid, maleic acid, etc. (examples of the alkyl group are methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2-furfurylethyl, 2-pyridinylethyl, 2-thienylethyl, trimethoxysilylpropyl, and 2-carboxyamidoethyl); styrene derivatives (e.g., styrene, vinyltoluene, α-methylstyrene, vinylnaphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, N,N-dimethylaminomethylstyrene, vinylbenzenecarboxyamide, and vinylbenzenesulfoamide); unsaturated carboxylic acids such as acrylic acid, methacrylic acid, crotonic acid, maleic acid, iraconic acid, etc.; cyclic anhydrides of maleic acid and itaconic acid; acrylonitrile; methacrylonitrile; and heterocyclic compounds having a polymerizable double bond (practically the compounds described in *Kobunshi (Macromolecular) Data Handbook (Foundation)*, pages 175–184, edited by Kobunshi Gakkai, published by Baifukan, 1986, for example, N-vinylpyridine, N-vinylimidazole, N-vinylpyrrolidone, vinylthiophene, vinyltetrahydrofuran, vinyloxazoline, vinylthiazole, and N-vinylmorpholine).

The monomers (A) may be used singly or as a combination thereof.

Now, the monofunctional macromonomer (MA) which can be used in the present invention will be described in greater detail below.

The monofunctional macromonomer (MA) is a macromonomer having a number average molecular weight of not more than $1\times10^4$ and having a polymerizable double bond group represented by the general formula (II) bonded to only one terminal of the main chain of the polymer composed of the repeating unit represented by the general formula (I).

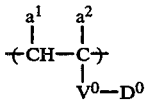

(I)

wherein $V^0$ represents —COO—, —OCO—, $-(CH_2)_r-COO-$, $-(CH_2)_rOCO-$, —O—, $—SO_2—$, —CONHCOO—, CONHCONH—,

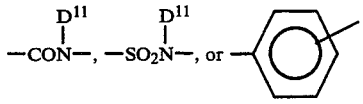

(wherein $D^{11}$ represents a hydrogen atom or a hydrocarbon group having from 1 to 22 carbon atoms; and r represents an integer of from 1 to 4); $a^1$ and $a^2$, which may be the same or different, each represents a hydrogen atom, a halogen atom, a cyano group, a hydrocarbon group, —COO—$D^{12}$, or —COO—$D^{12}$ bonded via a hydrocarbon group (wherein $D^{12}$ represents a hydrogen atom or a hydrocarbon group); and $D^O$ represents a hydrocarbon group having from 1 to 22 carbon atoms or a substituent selected from the substituents represented by the following general formula (IV):

$$-(A^1-B^1)_m(A^2-B^2)_nD^{21} \quad \text{(IV)}$$

wherein $D^{21}$ represents a hydrogen atom or a hydrocarbon group having from 1 to 22 carbon atoms; $B^1$ and $B^2$, which may be the same different, each represents —O—, —CO—, $—CO_2—$, —OCO—, $—SO_2—$,

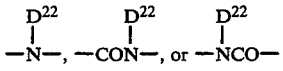

(wherein $D^{22}$ has the same meaning as $D^{21}$ defined above ); $A^1$ and $A^2$, which may be the same or different, each represents a hydrocarbon group having from 1 to 18 carbon atoms which may be substituted and which may contain an intervening group represented by the following formula in the main chain of the hydrocarbon group;

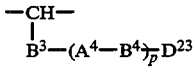

(wherein $B^3$ and $B^4$, which may be the same or different, each has the same meaning as $B^1$ and $B^2$; $A^4$ represents a hydrocarbon group having from 1 to 18 carbon atoms; and $D^{23}$ has the same meaning as $D^{21}$ defined above); m, n and p, which may be the same or different, each represents an integer of from 0 to 4, provided that m, n and p cannot be 0 at the same time;

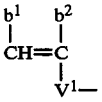

(II)

wherein $V^1$ has the same meaning as $V^0$ defined in the general formula (I); and $b^1$ and $b^2$, which may be the same or different, each has the same meaning as $a^1$ or $a^2$ defined in the general formula (I).

In the general formulae (I) and (II), the hydrocarbon groups included in $a^1$, $a^2$, $V^0$, $D^0$, $b^1$, $b^2$ and $V^1$ each has the carbon atom number (as the unsubstituted hydrocarbon group) defined above and may be substituted.

In the general formula (I), $D^{11}$ in the substituent represented by $V^0$ represents a hydrogen atom or a hydrocarbon group having from 1 to 22 carbon atoms and preferred examples of the hydrocarbon group are an alkyl group having from 1 to 22 carbon atoms, which may be substituted (e.g., methyl, ethyl, propyl, butyl, pentyl, hexyl, heptyl octyl, nonyl, decyl, dodecyl, tridecyl, tetradecyl, hexadecyl, octadecyl, eicosanyl, docosanyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms, which may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl, and linolenyl), an aralkyl group having from 7 to 12 carbon atoms, which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms, which may be substituted (e.g., cyclohexyl, 2-cyclohexylethyl, and 2-cyclopenthylethyl), and an aromatic group having from 6 to 12 carbon atoms, which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

When $V^0$ represents

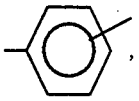

the benzene ring may have a substituent such as a halogen atom (e.g., chlorine and bromine), an alkyl group (e.g., methyl, ethyl, propyl, butyl, chloromethyl, and methoxymethyl) .

In the general formula (I), $a^1$ and $a^2$, which may be the same or different, each preferably represents a hydrogen atom, a halogen atom (e.g., chlorine and bromine), a cyano group, an alkyl group having from 1 to 3 carbon atoms (e.g., methyl, ethyl, and propyl ), —COO—$D^{13}$, or —$CH_2COOD^{13}$ ( wherein $D^{13}$ represents a hydrogen atom, an alkyl group having from 1 to 18 carbon atoms, an alkenyl group, an aralkyl group, an aliphatic group, or an aryl group and each of these groups may be substituted and specifically includes those described above for $D^{11}$).

When $D^O$ represents a hydrocarbon group having from 1 to 22 carbon atoms, specific examples of the hydrocarbon group include those described for $D^{11}$ above.

When $D^0$ represents a substituent represented by the general formula (IV), $A^1$ and $A^2$, which may be same or different, each represents a hydrocarbon group having from 1 to 18 carbon atoms, which may be substituted or may have $$\begin{array}{l} \text{—}\overset{|}{\text{CH}}\text{—} \\ \quad B^3\text{—}(A^3\text{—}B^4)_p\text{—}D^{23} \end{array}$$

in the main chain bond (wherein the hydrocarbon group is an alkyl group, an alkenyl group, an aralkyl group, or an alicyclic group and specifically includes those described for $D^{11}$ above.

Specific examples of $A^1$ and $A^2$ include $$\begin{array}{c} D^{31} \\ | \\ \text{—C—} \\ | \\ D^{32} \end{array}$$

(wherein $D^{31}$ and $D^{32}$ each represents a hydrogen atom, an alkyl group or a halogen atom), —(CH=CH)—, a phenylene group, a cyclohexylene group (which is hereinafter sometimes represented by —$C_6H_{10}$, including a 1,2-cyclohexylene group, a 1,3-cyclohexylene group and a 1,4-cyclohexylene group), or the atomic group $$\begin{array}{l} \text{—}\overset{|}{\text{CH}}\text{—} \\ \quad B^3\text{—}(A^4\text{—}B^4)_p\text{—}D^{23} \end{array} ,$$

or an appropriate combination thereof.

Also, in the linking group —$V^0$—$(A^1$—$B^1)_m$—$(A^2$—$B^2)_n$—$D^{21}$, it is preferred that the linkage main chain composed of $V^0$, $A^1$, $B^1$, $A^2$, $B^2$, and $D^{21}$ has a total number of atoms of at least 8. Further, —$B^3$—$(A^4$—$B^4)_p$—$D^{23}$, in the case where $A^1$ or $A^2$ represents a hydrocarbon group containing $$\begin{array}{l} \text{—}\overset{|}{\text{CH}}\text{—} \\ \quad B^3\text{—}(A^4\text{—}B^4)_p\text{—}D^{23} \end{array}$$

in the main chain bond is also included in the above-described linkage main chain.

As to the number of atoms of the linkage main chain, when, for example, $V^0$ represents —COO— or —CONH—, the oxo group (=O) and the hydrogen atom are not included in the number of atoms but the carbon atom(s), ether-type oxygen atom, and nitrogen atom each constituting the linkage main chain are included in the number of atoms. Thus, the number of atoms of —COO— or —CONH— is counted as 2 Also, when, for example, $R^{21}$ represents —$C_9H_{19}$, the hydrogen atoms thereof are not included in the number of atoms and the carbon atoms are included therein. Thus, the number of atoms in this case is counted as 9.

Specific examples of the repeating unit represented by the general formula (I) wherein $D^O$ represents a substituent represented by the general formula (IV), that is, the repeating unit containing two or more specific polar groups, include the following repeating units.

In the following chemical formulae, a represents —H or —$CH_3$, R represents an alkyl group having from 1 to 18 carbon atoms, R' represents a hydrogen atom or an alkyl group having from 1 to 18 carbon atoms, $k_1$ and $k_2$ each represents an integer of from 1 to 12, and $m_1$ represents an integer of from 1 to 100.

$$\begin{array}{l} \quad\quad\quad a \\ \quad\quad\quad | \\ (\text{CH}_2\text{—}\overset{|}{\text{C}}) \\ \quad\quad\quad | \\ \quad\quad\quad \text{COO}(\text{CH}_2)_{k_1}\text{—OCOR} \end{array} \qquad \text{(I-1)}$$

-continued (I-2)

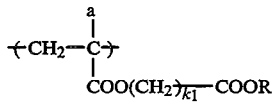

(I-3)

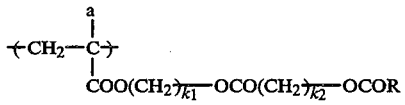

(I-4)

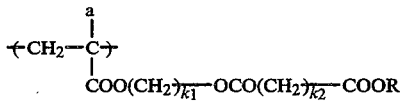

(I-5)

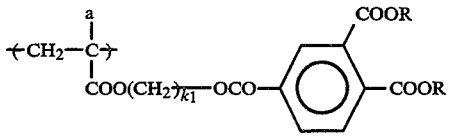

(I-6)

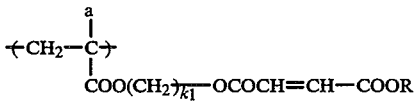

(I-7)

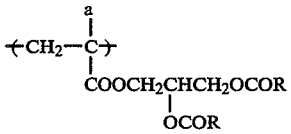

(I-8)

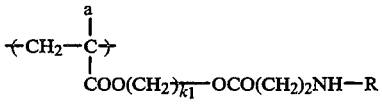

(I-9)

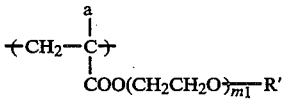

(I-10)

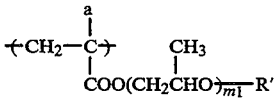

(I-11)

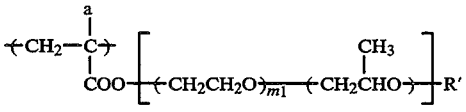

(I-12)

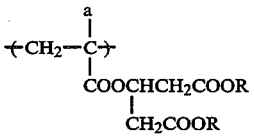

(I-13)

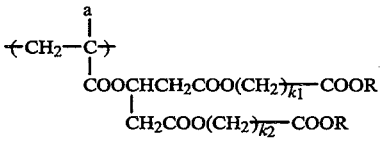

(I-14)

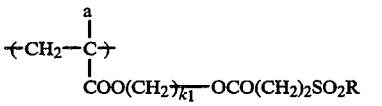

-continued (I-15)

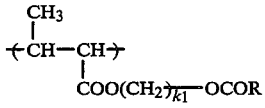

(I-16)

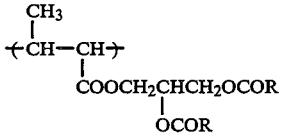

(I-17)

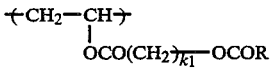

(I-18)

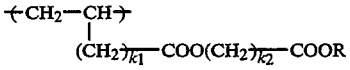

The macromonomer (MA) for use in the present invention has the chemical structure that the polymerizable double bond group represented by the general formula (II) bonded to only one terminal of the polymer main chain composed of the repeating unit represented by the general formula (I) directly or via an appropriate linkage group.

In the general formula (II), $V^1$ has the same meaning as $V^0$ in the general formula (I); $b^1$ and $b^2$, which may be the same or different, each has the same meaning as $a^1$ or $a^2$ in the general formula (I).

Also, preferred example of $V^1$, $b^1$, $b^2$ are the same as those described above for $V^0$, $a^1$, and $a^2$. It is more preferred that one of $b^1$ and $b^2$ in the general formula (II) is a hydrogen atom.

The linkage group which connects the moiety represented by the general formula (I) and the moiety represented by the general formula (II) is composed of an appropriate combination of the atomic group of a carbon-carbon bond (single bond or double bond), a carbon-hetero atom bond (examples of the hetero atom are oxygen atom, sulfur atom, nitrogen atom, and silica atom), or a hetero atom-hetero atom bond.

Preferred examples of the macromonomer (MA) used in the present invention include those represented by the following general formulae (VI):

(VI)

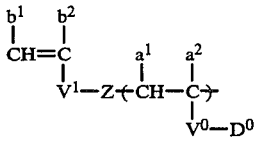

wherein symbols other than Z have the same meaning as the symbols in the general formulae (I) and (II); and Z represents a mere bond or a linkage group selected from the atomic groups of

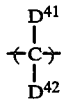

(wherein $D^{41}$ and $D^{42}$ each represents a hydrogen atom, a halogen atom (e.g., fluorine, chlorine, and bromine), a cyano group, a hydroxy group, or an alkyl group (e.g., methyl, ethyl, and propyl),

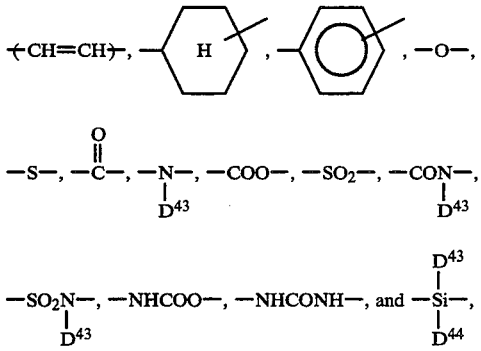

(wherein $D^{43}$ and $D^{44}$ each represents a hydrogen atom or a hydrocarbon group which has the same meaning as described above on $D^{11}$),

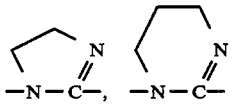

and an appropriate combination thereof.

Particularly preferred examples of $a^1$, $a^2$, $b^1$, $b^2$, $V^0$, in $V^1$ in the general formula (VI) are described below.

Specifically, $V^0$ is —COO—, —OCO—, —O—, —$CH_2$COO—, or —$CH_2$OCO—; $V^1$ is the above described ones (wherein $D^{11}$ is a hydrogen atom); and $a^1$, $a^2$, $b^1$, and $b^2$ are a hydrogen atom or a methyl group.

Specific examples of moieties represented by

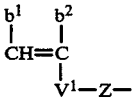

in the general formula (VI) are shown below, but the present invention should not be construed as being limited thereto.

In the following chemical formulae, b represents —H or —$CH_3$, $m_1$ represents an integer of from 1 to 12, and $n_1$ represents an integer of 2 to 12.

(II'-1)

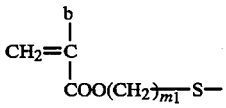

(II'-2)

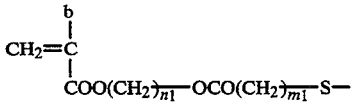

(II'-3)

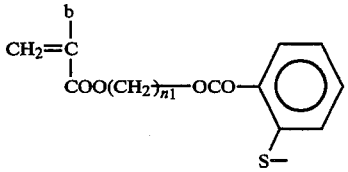

(II'-4)

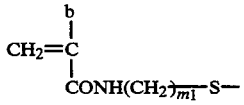

-continued (II'-5)

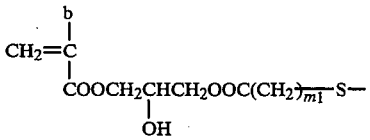

(II'-6)

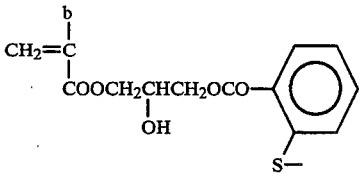

(II'-7)

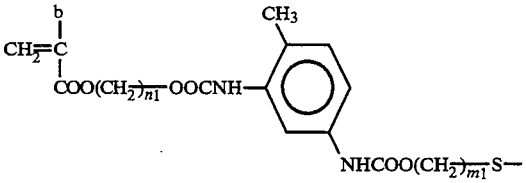

(II'-8)

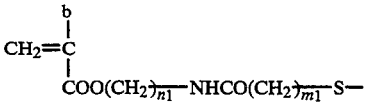

(II'-9)

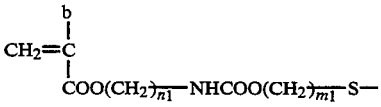

(II'-10)

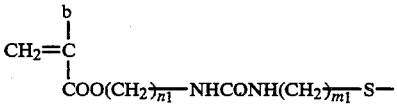

(II'-11)

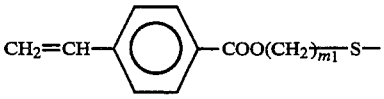

(II'-12)

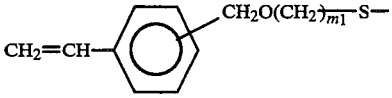

(II'-13)

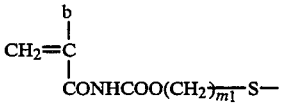

(II'-14)

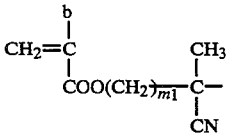

(II'-15)

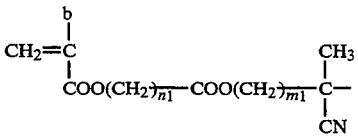

(II'-16)

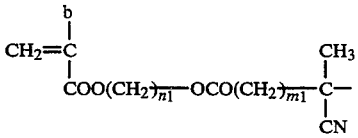

-continued (II'-17)

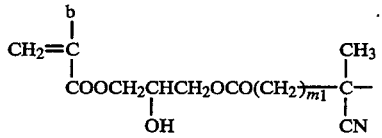

(II'-18)

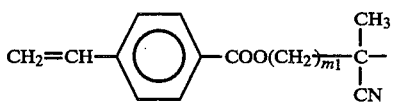

(II'-19)

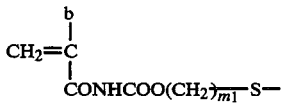

(II'-20)

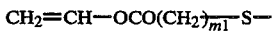

(II'-21)

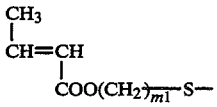

(II'-22)

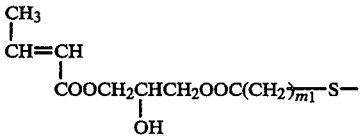

(II'-23)

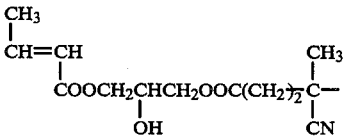

(II'-24)

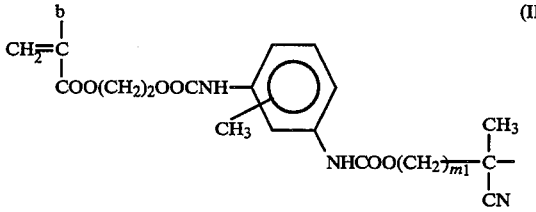

(II'-25)

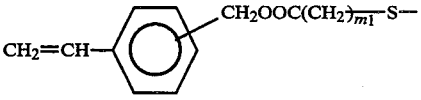

(II'-26)

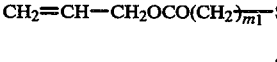

(II'-27)

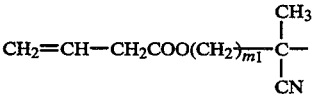

(II'-28)

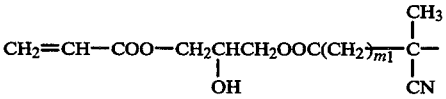

(II'-29)

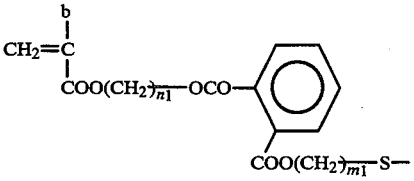

-continued (II'-30)

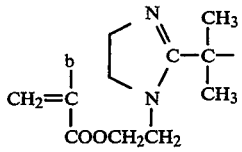

(II'-31)

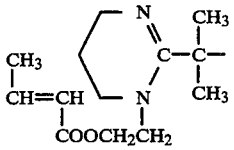

Also, the macromonomer (MA) for use in the present invention may contain other repeating unit together with the repeating unit represented by the general formula (I) as a copolymer component. As such other copolymer components, a monomer capable of copolymerizing with the monomer corresponding to the repeating unit represented by the general formula (I) can be used in the present invention. Examples thereof include unsaturated carboxylic acids such as acrylic acid, methacrylic acid, iraconic acid, crotonic acid, maleic acid, vinylacetic acid, 4-pentenic acid, etc.; esters or amides of these unsaturated carboxylic acids; vinyl esters or allyl esters of fatty acids having from 1 to 22 carbon atoms; vinyl ethers; styrene and styrene derivatives; and heterocyclic compounds having an unsaturated bonding group. Specifically, there are the compounds illustrated above for the monomer (A).

It is preferred the content of the repeating unit represented by the general formula (I) is at least 40% by weight and more preferably from 60 to 100% by weight of the whole repeating units present in the macromonomer (MA).

If the content of the component represented by the general formula (I) is less than 40% by weight, the mechanical strength of the image portions formed by the dispersion resin grains is not sufficiently retained, whereby the effect of improving the printing durability is not obtained in the case of use for offset master plates.

The number average molecular weight of the macromonomer (MA) in the present invention is preferably from $1\times10^3$ to $1\times10^4$, and more preferably from $2\times10^3$ to $9\times10^3$.

If the upper limit of the number average molecular weight of the macro monomer (MA) exceeds $1\times10^4$, the printing durability is lowered. On the other hand, if the molecular weight is two low, there is a tendency of causing stains. Thus, it is preferred that the molecular weight is not less than $1\times10^3$.

The macromonomer (MA) used in the present invention can be prepared by conventionally known synthesis methods.

For example, there are (1) a method by an ion polymerization method of forming a macromonomer by reacting various reagents to the terminal of a living polymer obtained by an anion polymerization or a cation polymerization, (2) a method by a radical polymerization method of forming a macromonomer by reacting an oligomer having a reactive group at the terminal obtained by a radical polymerization using a polymerization initiator and/or a chain transfer agent having a reactive group such as a carboxy group, a hydroxy group, an amino group, etc., in the molecule, and (3) a method by a polycondensation method of introducing a polymerizable double bond group into an oligomer obtained by a poly-addition or poly-condensation reaction in the same manner as the above radical polymerization method.

Specifically, the macromonomer (MA) can be prepared by the methods as described, e.g., in P. Dreyfuss & R.P. Quirk, *Encycl. Polym. Sci. Eng.*, 7, 551(1987), P.F. Rempp & E. Franta, *Adv. Polym. Sci.*, 58, 1(1984), V. Percec, *Appl. Polym. Sci.*, 285, 95(1984), R. Asami & M. Takari, *Makromol. Chem. Suppl.*, 12, 163 (1985), P. Rempp. et al, *Makromol Chem. Suppl.*, 8, 3 (1984 ), Yushi Kawakami, *Kagaku Kogyo* (*Chemical Industry*), 38, 56(1987), Yuya Yamashita, *Kobunshi* (*High Polymer*), 31, 988(1982), Shiro Kobayashi, ibid., 30, 625(1981), Toshinobu Higashimura, *Journal of Adhesive Society of Japan*, 18, 536(1982), Koichi Ito, *Kobunshi Kako* (*Polymer Processing*), 35, 262(1986), and Kishiro Higashi and Takashi Tsuda, *Kino Zairyo* (*Functional Materials*), 1987, No. 10, page 5 and the literature references and patents cited therein.

Examples of the polymerization initiator having the specific reactive group in the molecule include azobis compounds such as 4,4'-azobis(4-cyanovaleric acid), 4,4'-azobis(4-cyanovaleric acid chloride), 2,2'-azobis(2-cyanopropanol), 2,2'-azobis(2-cyanopentanol), 2,2'-azobis[2-methyl-N-(2-hydroxyethyl)propioamide], 2,2'-azobis{2-methyl-N-[1,1-bis(hydroxymethyl)ethyl]-propioamide}, 2,2'-azobis{2-methyl-N-[1,1-bis(hydroxymethyl)-2-hydroxyethyl]propioamide}, 2,2'-azobis[2-(5-methyl-2-imiszolin-2-yl)propane], 2,2'-azobis[2-(4,5,6,7-tetrahydro-1H-1,3-diazepin-2-yl)-propane], 2,2'-azobis[2-(3,4,5,6-tetrahydropyrimidin-2-yl)propane]2,2'-azobis[2-(5-hydroxy-3,4,5,6-tetrapyrimidin-2-yl)-propane], 2,2'-azobis{2-[1-(2-hydroxyethyl)-2-imidazolin-2-yl]propane}, 2,2'-azobis[N-(2-hydroxyethyl)-2-methylpropionamidine], and 2,2'-azobis[N-(4-aminophenyl)-2-methylpropionamidine].

Also, examples of the chain transfer agent having the specific reactive group in the molecule include mercapto compounds having the reactive group or a substituent capable of being converted into the reactive group (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-l,2-propanediol, 1-mercapto-2-propanol, 3-mercapto-2-butanol, mercaptophenol, 2-mercaptoethylamine, 2-mercaptoimidazole, and 2-mercapto-3-pyridinol) and iodized alkyl compounds having the reactive group or a substituent capable of being converted into the reactive group (e.g., iodoacetic acid, iodopropionic acid, 2-iodoethanol, 2-iodoethanesulfonic acid, and 3-iodopropanesulfonic acid). Of these compounds, the mercapto compounds are preferred.

The chain transfer agent or polymerization initiator is used in an amount of preferably from 0.5 to 20 parts by weight, and more preferably from 1 to 10 parts by weight per 100 parts by weight of the monomer corresponding to the repeating unit represented by the general formula (I).

Now, the oligomer (B) which can be used in the present invention will be described in greater detail below.

The oligomer (B) is an oligomer having a number average molecular weight of not more than $1\times10^4$ and having a polar group selected from a carboxy group, a sulfo group, a hydroxy group, a formyl group, an amino group, a phosphono group and

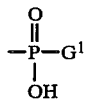

(wherein $G^1$ represents a hydrocarbon group or —$OG^2$ (wherein $G^2$ represents a hydrocarbon group) bonded to only one terminal of the main chain of a polymer composed of a repeating unit represented by the general formula (I) described above.

The oligomer (B) used in the present invention may contain other repeating unit together with the repeating unit represented by the genera formula (I) as a copolymer component. As such other copolymer components, those described hereinbefore with respect to the macromonomer (MA) can be employed.

It is preferred the content of the repeating unit represented by the general formula (I) is at least 40% by weight and more preferably from 60 to 100% by weight of the whole repeating units present in the oligomer (B).

If the content of the component represented by the general formula (I) is less than 40% by weight, the mechanical strength of the image portions formed by the dispersion resin grains is not sufficiently retained, whereby the effect of improving the printing durability is not obtained in the case of use for offset master plates.

The number average molecular weight of the oligomer (B) in the present invention is preferably from $1\times10^3$ to $1\times10^4$, and more preferably from $2\times10^3$ to $9\times10^3$.

If the upper limit of the number average molecular weight of the oligomer (B) exceeds $1\times10^4$, the printing durability is lowered. On the other hand, if the molecular weight is two low, there is a tendency of causing stains. Thus, it is preferred that the molecular weight is not less than $1\times10^3$.

In

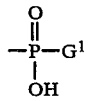

which is one of the polar groups bonded to only one terminal of the polymer main chain of the oligomer used in the present invention, $G^1$ represents a hydrocarbon or —$OG^2$ (wherein $G^2$ represents a hydrocarbon group). The hydrocarbon group represented by $G^1$ or $G^2$ is preferably a hydrocarbon group having from 1 to 18 carbon atoms, and more preferably an aliphatic group having from 1 to 8 carbon atoms which may be substituted (e.g., methyl, ethyl, propyl, butyl, pentyl, hexyl, butenyl, pentenyl, hexenyl, 2-chloroethyl, 2-cyanoethyl, cyclopentyl, cyclohexyl, benzyl, phenethyl, chlorobenzyl, and bromobenzyl) or an aromatic group which may be substituted (e.g., phenyl, tolyl, xylyl, mesityl, chlorophenyl, bromophenyl, methoxyphenyl, and cyanophenyl).

Also, the amino group in the polar groups described above represents $-NH_2$, $-NHG^3$, or

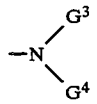

(wherein $G^3$ and $G^4$ each represents a hydrocarbon group having from 1 to 18 carbon atoms, and preferably a hydrocarbon group having from 1 to 8 carbon atoms). Specific examples of the hydrocarbon group are same as those described for $G^1$ or $G^2$ above.

As more preferred examples of the hydrocarbon group represented by $G^1$, $G^2$, $G^3$ and $G^4$, there are an alkyl group having from 1 to 4 carbon atoms which may be substituted, a benzyl group which may be substituted or a phenyl group which may be substituted.

The polar group has a chemical structure that the group is bonded to one terminal of the polymer main chain directly or via an appropriate linkage group.

The linkage group which connects the polymer main chain and the polar group is composed of an appropriate combination of the atomic group of a carbon-carbon bond (single bond or double bond), a carbon-hetero atom bond (examples of the hetero atom are oxygen, sulfur, nitrogen, and silicon atoms), or a hetero atom-hetero atom bond. formula (I)), —NHCOO—, —NHCONH— and an appropriate combination thereof.

Also, it is preferred that the oligomer (B) does not contain a polymer component having the polar group such as a phosphono group, a carboxy group, a sulfo group, a hydroxy group, a formyl group, an amino group, and

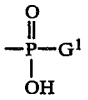

in the polymer main chain.

The oligomer (B) used in the present invention having the specific polar group bonded to only one terminal of the polymer main chain can be easily produced by conventionally known methods, by example, (1) a method of reacting various reagents to the terminal of a living polymer obtained by an anion polymerization or cation polymerization (a method using ion polymerization), (2) a method of performing a radical polymerization using a polymerization initiator and/or chain transfer agent each having the specific polar group in the molecule (a method using radical polymerization), or (3) a method of forming a polymer having a reactive group at the terminal thereof by the above described ion polymerization method or radical polymerization method and then converting the reactive group to the specific Preferred examples of the oligomer (B) for use in the present invention are represented by following general formula (VIIa) or (VIIb);

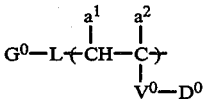

(VIIa)

-continued

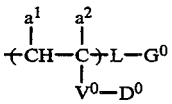

(VIIb)

wherein $a^1$, $a^2$, $V^0$ and $D^0$ each has the same meaning as defined in the general formula ( I ); $G^O$ represents the specific polar group; and L represents a mere bond or a linkage group selected from the atomic groups of

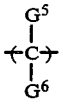

(wherein $G^5$ and $G^6$ each represents a hydrogen atom, a halogen atom (e.g., fluorine, chlorine, and bromine), a cyano group, a hydroxy group, or an alkyl group (e.g., methyl, ethyl, and propyl)),

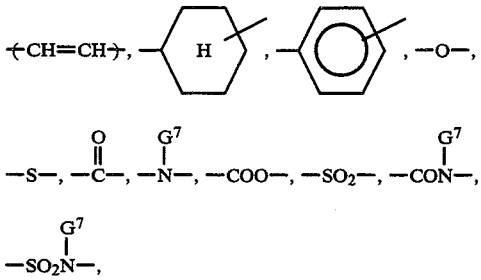

(wherein $G^7$ represents a hydrogen atom or a hydrocarbon group having from 1 to 18 carbon atoms which has the same meaning as described above on $D^{11}$ in the general polar group of the present invention by a polymer reaction.

Specifically, the oligomer (B) can be produced by the methods as described, for example, in P. Dreyfuss & R.P. Quirk, *Encycl. Polym. Sci. Eng*, 7, 551(1987), Yoshiki Nakajo & Yuuya Yamashita, *Senryo to Yakuhin* (*Dyes and Chemicals*), 30, 232(1985), and Akira Ueda & Susumu Nagai, *Kagaku to Kogyo* (*Science and Industry*), 60, 57(1986), and the literature references cited therein.

Examples of the polymerization initiator having the specific polar group in the molecule include 4,4 '-azobis(4-cyanovaleric acid) , 4,4 '-azobis(4-cyanovaleric acid chloride), 2,2'-azobis (2-cyanopropanol), 2,2'-azobis[2-methyl-N-(2-hydroxyethyl)propioamide], 2,2'-azobis{2-methyl-N- [1,1-bis(hydroxymethyl)ethyl]-propioamide}, 2,2'-azobis{2-methyl-N-[1,1-bis(hydroxymethyl)-2-hydroxyethyl]propioamide}, 2,2'-azobis[2- ( 5-methyl-2-imidazolin-2-yl)propane], 2,2'-azobis[2-(4,5,6,7-tetrahydro-1H-1,3-diazepin-2-yl)propane], 2,2'-azobis[2-(3,4,5,6-tetrahydropyrimidin-2-yl)propane], 2,2'-azobis[2-(5-hydroxy-3,4,5,6-tetrapyrimidin-2-yl)propane], 2,2'-azobis{2-[1-(2-hydroxyethyl )-2-imidazolin-2-yl ]propane}, 2,2'-azobis[N-(2-hydroxyethyl)-2-methylpropionamidine], and 2,2'-azobis[N-(4-aminophenyl)-2-methylpropionamidine]

Also, the chain transfer agents having the specific polar group in the molecule include, for example, mercapto compounds, disulfide compounds and iodide-substituted compounds, and mercapto compounds are preferred. Specific examples thereof include thioglycolic acid, 2-mercaptopropionic acid, thiomalic acid, 2-mercaptoethanesulfonic acid, 2-mercaptoethanol, 2-mercaptoethylamine, thiosalicylic acid, α-thioglycerol, 2-phosphonoethylmercaptan, hydroxythiophenol, and derivatives of these mercapto compounds.

The polymerization initiator or chain transfer agent is used in an amount of preferably from 0.5% to 20% by weight, and more preferably from 1 to 10% by weight per the total amount of the monomer corresponding to the repeating unit represented by the general formula (I) and, if any, other polymerizable monomer(s).

Preferred oligomers (B) used in the present invention include those represented by the general formula (Ia) or (Ib) described above, and specific examples of the moiety shown by G-L- in these formulae are illustrated below, although the present invention should not be construed as being limited thereto.

In the following formulae, $k_1$ represents an integer of 1 or 2, $k_2$ represents an integer of from 2 to 16, and R represents an alkyl group having from 1 to 6 carbon atoms.

$HOOC\text{-}(CH_2)_{k1}\text{-}S\text{-}$ (B)-1

$HOOC\text{-}CH(HOOC\text{-}CH_2)\text{-}S\text{-}$ (B)-2

$HOOC(CH_2)_{k2}\text{-}OOC\text{-}(CH_2)_{k1}\text{-}S\text{-}$ (B)-3

$HOOC(CH_2)_{k2}\text{-}NHCO\text{-}(CH_2)_{k1}\text{-}S\text{-}$ (B)-4

(B)-5

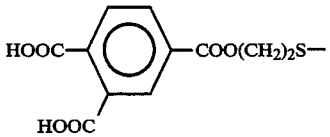

(B)-6

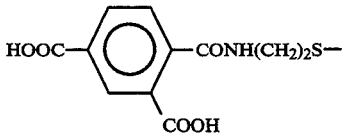

$HO(CH_2)_{k1}\text{-}S\text{-}$ (B)-7

$H_2N(CH_2)_{k2}\text{-}S\text{-}$ (B)-8

$HOCH(HOCH_2)\text{-}CH_2S\text{-}$ (B)-9

(B)-10

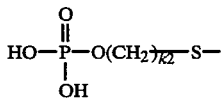

(B)-11

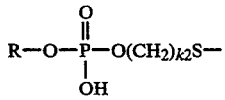

$HO_3S(CH_2)_2S\text{-}$ (B)-12

(B)-13

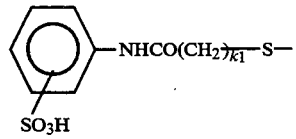

-continued (B)-14

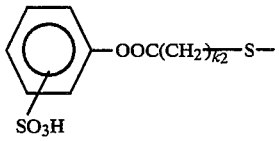

(B)-15

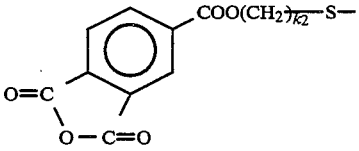

(B)-16

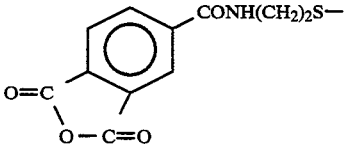

The monomer (D) having two or more polymerizable functional groups which is copolymerizable with the monomer (A) (hereinafter sometimes referred to as polyfunctional monomer (D)) used in the present invention in combination with the monofunctional monomer (A) and the monofunctional macromonomer (A) or the oligomer (B) will be described in more detail below.

The polymerizable functional group contained in the polyfunctional monomer (D) may be any group which is copolymerizable with the monomer (A), and a specific example of the functional group is represented by the following general formula (VII)

(VII)

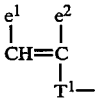

wherein $e^1$, $e^2$, and $T^1$ have the same meaning as $e^1$, $e^2$ and $T^1$, respectively, defined in the above described general formula (V).

Also, the polyfunctional monomer (D) may be a monomer having 2 or more same or different polymerizable functional groups, and forms a polymer insoluble in the non-aqueous solvent by polymerizing with the monomer (A) and the monofunctional macromonomer (MA) or the oligomer (B).

Examples of the monomer having same polymerizable functional groups include styrene derivatives such as divinylbenzene, trivinylbenzene, etc.; methacrylic acid, acrylic acid or crotonic acid esters of a polyhydric alcohol (e.g., ethylene glycol, diethylene glycol, triethylene glycol, polyethylene glycols #200, #400, and #600, 1,3-butylene glycol, neopentyl glycol, dipropylene glycol, polypropylene glycol, trimethylolpropane, trimethylolethane, and pentaerythritol) or a polyhydroxyphenol, (e.g., hydroquinone, resorcinol, catechol, and the derivative thereof ), vinyl ethers, and allyl ethers; vinyl esters, allyl esters, vinylamides and allyl amides of a dibasic acid (e.g., malonic acid, succinic acid, glutaric acid, adipic acid, pimelic acid, maleic acid, phthalic acid, and itaconic acid); and condensates of polyamines (e.g., ethylenediamine, 1,3-propylenediamine, and 1,4-butylenediamine ) and a carboxylic acid having a vinyl group (e.g., methacrylic acid, acrylic acid, crotonic acid, and allylacetic acid).

Also, examples of the monomer having different polymerizable functional groups include vinyl group-having ester derivatives or amide derivatives (e.g., vinyl methacrylate, vinyl acrylate, vinyl itaconate, allyl itaconate, allyl acrylate, allyl itaconate, vinyl methacryloylacetate, vinyl methacryloylpropionate, allyl methacryloylpropionate, methacrylic acid vinyloxycarbonyl methyl ester, acrylic acid vinyloxycarbonylmethyloxy-carbonylethylene ester, N-allylacrylamide, N-allylmethacrylamide, N-allylitaconic acid amide, and methacryloylpropionic acid allyl amide) of vinyl group-having carboxylic acids (e.g., methacrylic acid, acrylic acid, methacryloylacetic acid, acryloylacetic acid, methacryloylpropionic acid, acryloylpropionic acid, itaconiloylacetic acid, itaconyloylpropionic acid, and reaction products of carboxylic acid anhydrides and alcohols or amines (e.g., allyloxycarbonylpropionic acid, allyloxycarbonylacetic acid, 2-allyloxycarbonylbenzoic acid, and allylaminocarbonylpropionic acid)); and condensates of aminoalcohols (e.g., aminoethanol, 1-aminopropanol, 1-aminobutanol, 1-aminohexanol, and 2-aminobutanol) and vinyl group-having carboxylic acids.

The dispersed resin according to the present invention comprises at least one of each of the monomer (A), the monofunctional macromonomer (MA) or the oligomer (B) and monomer (D). It is important that when a resin synthesized from such monomers is insoluble in the non-aqueous solvent, the desired dispersed resin grain can be obtained.

More specifically, it is preferred to use from 0.1 to 20% by weight, more preferably from 0.3 to 8% by weight, of the monofunctional macromonomer (MA) or oligomer (B) to the monomer (A) to be insolubilized.

The monomer (D) having two or more polymerizable functional groups used in the present invention is employed in an amount of not more than 20 mol %, preferably not more than 10 mol %, of the total monomers including the monofunctional macromonomer (MA), if any.

In the dispersed resin grains produced by polymerization granulation according to the present invention, the monofunctional macromonomer (MA) is copolymerized with the monofunctional monomer (A) and the polyfunctional monomer (D) since the macromonomer (MA) has a polymerizable double bond group bonded to only one terminal of the main chain thereof, when the macromonomer (MA) is employed. On the other hand, when the oligomer (B) is used, it is believed that the oligomer (B) adsorbes on the dispersed resin grains formed from the monomer (A) and the monomer (D) at its specific polar group bonded to only one terminal of the main chain thereof.

The dispersed resin of the present invention preferably has a molecular weight of from $1\times103$ to $1\times10^6$, more preferably from $1\times10^4$ to $1\times10$hu 6.

The dispersion-stabilizing resin (P) of the present invention used for forming a stable resin dispersion of the polymer which is insoluble in the non-aqueous solvent and which is produced by polymerization of the monomers in the non-aqueous solvent is a polymer containing at least one repeating unit represented by the general formula (II). The polymer is partially crosslinked in the polymer main chain and is a resin insoluble in the non-aqueous solvent.

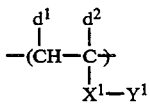

(III)

wherein $X^1$ represents —CO0—, —OCO—, —$CH_2$OCO—, —$CH_2$COO—, —O— or —$SO_2$—, $Y^1$ represents an aliphatic group having from 6 to 32 carbon atoms, $d^1$ and $d^2$, which may be the same or different, each represents a hydrogen atom, a halogen atom, a cyano group, a hydrocarbon group having from 1 to 8 carbon atoms, —COO—$Z^1$ or —COO—$Z^1$ bonded via a hydrocarbon group having from 1 to 8 carbon atoms (wherein $Z^1$ represents a hydrocarbon group having from 1 to 22 carbon atoms).

In the repeating unit represented by the general formula (III), the aliphatic group and the hydrocarbon group may be substituted.

In the general formula (III), $X^1$ ms preferably —COO—, —OCO—, —$CH_2$OCO—, —$CH_2$COO— or —O—, more preferably —COO—, —$CH_2$COO— or —O—.

$Y^1$ preferably represents an alkyl group, an alkenyl group or an aralkyl group having from 8 to 22 carbon atoms which may be substituted- Examples of the substituent include a halogen atom (e.g., fluorine, chlorine and bromine), —O—$Z^2$, —COO—$Z^2$ and —OCO—$Z^2$ wherein $Z^2$ represents an alkyl group having from 6 to 22 carbon atoms (e.g., hexyl octyl, decyl, dodecyl, hexadecyl and octadecyl). More preferably, $Y^1$ represents an alkyl group or an alkenyl group having from 8 to 22 carbon atoms, for example, octyl, decyl, dodecyl, tridecyl tetradecyl, hexadecyl, octadecyl, docosanyl, decenyl, dodecenyl, tetradecenyl, hexadecenyl, and octadecenyl.

$d^1$ and $d^2$, which may be the same or different, each preferably represents a hydrogen atom, a halogen atom (e.g., fluorine, chlorine and bromine), a cyano group, an alkyl group having 1 to 3 carbon atoms, —COO—$Z^3$ or —$CH_2$COO—$Z^3$ (wherein $Z^3$ represents an aliphatic group having from 1 to 22 carbon atoms, e.g., methyl, ethyl, propyl, butyl, hexyl, octyl, decyl, dodecyl, tridecyl, tetradecyl, hexadecyl, octadecyl, docosanyl, pentenyl, hexenyl, heptenyl, octenyl, decenyl, dodecenyl, tetradecenyl, hexadecenyl and octadecenyl, and these aliphatic groups may be substituted with the substituent as defined for $Y^1$ above). More preferably, $d^1$ and $d^2$ each represents a hydrogen atom, an alkyl group having from 1 to 3 carbon atoms (e.g., methyl, ethyl and propyl), —COO—$Z^4$ or —$CH_2$COO—$Z^4$ (wherein $Z^4$ represents an alkyl group or an alkenyl group having up to 12 carbon atoms, e..g., methyl, ethyl, propyl, butyl, hexyl, octyl, decyl, dodecyl, pentenyl, hexenyl, heptyl, octenyl and decenyl, and these alkyl and alkenyl groups may have a substituent as defined for Y1 above).

The dispersion-stabilizing resin (P) of the present invention contains a copolymer component obtained by copolymerizing a monomer corresponding to the repeating unit represented by the general formula (III) above and other monomers which are copolymerizable with the above monomer, and is a polymer partially crosslinked in the polymer main chain thereof.

Other copolymerizable monomers may be any monomers containing a polymerizable double bond group, and examples of other monomers include unsaturated carboxylic acids such as acrylic acid, methacrylic acid, crotonic acid, and itaconic acid; ester derivatives or amide derivatives of unsaturated carboxylic acids having not more than 6 carbon atoms; vinyl esters or allyl esters of carboxylic acids; styrenes; methacrylonitrile; acrylonitrile; and heterocyclic compounds containing a polymerizable double bond group. More specifically, the monomer includes the compounds illustrated as the above-described monomer (A) to be insolubilized.

The proportion of the repeating unit component represented by the general formula (III) in the polymer components of the dispersion-stabilizing resin (P) is at least 30 wt %, preferably 50 wt % or more, and more preferably 70 wt % or more, based on the total polymer components.

As a method for introducing a crosslinking structure into the polymer, a conventional method can be used. More specifically, (1) a method for polymerization reaction of monomers in the presence of a polyfunctional monomer, and (2) a method for crosslinking by polymer reaction by incorporating a functional group which promotes a crosslinking reaction into the polymer.

In the dispersion-stabilizing resin (P) of the present invention, a crosslinking reaction by a functional group having a self-crosslinking ability, i.e, $-CONHCH_2OZ^5$ wherein $Z^5$ represents a hydrogen atom or an alkyl group) or a crosslinking reaction by polymerization is appropriately used since these methods do not suffer from problems such as a reaction for a long period of time, a non-quantitative reaction and contamination with impurities such as reaction accelerating agents.

The term "crosslinking reaction by polymerization" means a crosslinking between polymer chains by polymerization of the monomer having, preferably, at least two polymerizable functional groups and the monomer corresponding to the repeating unit represented by formula (III) above.

Specific examples of polymerizable functional groups include $CH_2{=}CH{-}$, $CH_2{=}CH{-}CH_2{-}$, $CH_2{=}CH{-}CO{-}O{-}$, $CH_2{=}C(CH_3){-}COO{-}$, $CH_3{-}CH{=}CH{-}COO{-}$, $CH_2{=}CH{-}CONH{-}$, $CH_2{=}C(CH_3){-}CONH{-}$, $CH_2{=}C(CH_3){-}CONHCOO{-}$, $CH_2{=}C(CH_3){-}CONHCONH{-}$, $CH_3{-}CH{=}CH{-}CONH{-}$, $CH_2{=}CH{-}OCO{-}$, $CH_2{=}C(CH_3){-}OCO{-}$, $CH_2{=}CH{-}CH_2{-}OCO{-}$, $CH_2{=}CH{-}NHCO{-}$, $CH_2{=}CH{-}CH_2{-}NHCO{-}$, $CH_2{=}CH{-}SO_2{-}$, $CH_2{=}CH{-}CO{-}$, $CH_2{=}CH{-}O{-}$, $CH_2{=}CH{-}S{-}$.

The monomers having two or more polymerizable functional groups may be those having the same or different polymerizable functional groups described above.

Specific examples of the monomer having two or more polymerizable functional groups include the compounds as described for the polyfunctional monomers (D).

The monomer having two or more polymerizable functional groups in the resin (P) of present invention is used for the polymerization in an amount of not more than 10 wt %, preferably not more than 8 wt %, to form a resin which is soluble in the non-aqueous solvent according to the present invention.

The dispersion-stabilizing resin (P) according to the present invention preferably has a specific polar group bonded to at least one terminal of the polymer chain thereof. (The resin of this type is hereinafter sometimes specifically referred to as dispersionstabilizing resin (PA) or resin (PA).)

The specific polar group is selected from $-PO_3H_2$, $-SO_3H$, $-COOH$,

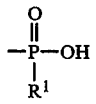

(wherein $R^1$ represents a hydrocarbon group or $-OR^2$ (wherein $R^2$ represents a hydrocarbon group)), $-OH$, a formyl group,

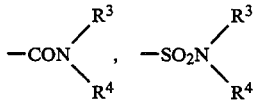

(wherein $R^3$ and $R^4$ each represents a hydrogen atom or a hydrocarbon group), a cyclic acid anhydride-containing group and an amino group.

In the polar group represented by

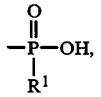

the hydrocarbon group of $R^1$ or $R^2$ is preferably a hydrocarbon group having from 1 to 10 carbon atoms, more preferably an aliphatic group having from 1 to 8 carbon atoms, which may be substituted (e.g., methyl, ethyl, propyl, butyl, pentyl, hexyl, butenyl, pentenyl, hexenyl, 2-chloroethyl, 2-cyanoethyl, cyclopentyl, cyclohexyl, benzyl, phenethyl, chlorobenzyl, and bromobenzyl), or an aromatic group which may be substituted (e.g., phenyl, tolyl, xylyl, mesityl, chlorophenyl, bromophenyl, methoxyphenyl, and cyanophenyl).

In the polar group of

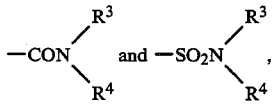

$R^3$ and $R^4$ each represents a hydrogen atom or a hydrocarbon group, preferably a hydrocarbon group having from 1 to 8 carbon atoms, which may be substituted. Specific examples of the hydrocarbon group represented by $R^3$ and $R^4$ are the same as those described for $R^1$ and $R^2$ above.

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for examples, a halogen atom such as a chlorine atom and a bromine atom, and an alkyl group such as a methyl group, an ethyl group, a butyl group and a hexyl group.

Specific examples of the aromatic dicarboxylic acid anhydrides include phthalic anhydride ring, naphthalene-dicarboxylic acid anhydride ring, pyridinedicarboxylic acid anhydride ring and thiophenedicarboxylic acid anhydride ring. These rings may be substituted with, for example, a halogen atom (e.g., chlorine and bromide), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

Of the above polar groups, the amino group is represented by $-NH_2$, $-NHR^5$ or $-NR^5R^6$ wherein $R^5$ and $R^6$ each represents a hydrocarbon group having from 1 to 8 carbon atoms, preferably from 1 to 7 carbon atoms. Specific examples of the hydrocarbon groups are the same as those described for $R^1$ above.

In the dispersion-stabilizing resin (PA), at least one specific polar group described above may be bonded to one terminal of the polymer main chain directly or via an appropriate linking group. The linking group bonding a component of the polymer chain and a polar group-containing component is composed of any combination of the atomic groups of a carbon-carbon bond (a single bond or a double bond), a carbon-heteroatom bond (e.g., an oxygen atom, a sulfur atom, a nitrogen atom or a silicon atom as a heteroatom), a heteroatom-heteroatom bond.

Specific examples of suitable linking group include

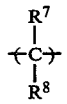

(wherein $R^7$ and $R^8$, which may be the same or different, each represents a hydrogen atom, a halogen atom (e.g., fluorine, chlorine, and bromide), a cyano group, a hydroxyl group, an alkyl group (e.g., methyl, ethyl, and propyl), —(CH=CH—, $-C_6H_{10}-$ (which represents 1,2-, 1,3- or 1,4-cyclohexylene), a phenylene group, —O—, —S—, —CO—, $-NR^9-$, —COO—, $-SO_2-$, $-CONR^9-$, $-SO_2NR^9-$, —NHCOO—, —NHCONH—, $-SiR^9R^{10}-$ (wherein $R^9$ and $R^{10}$ each represents a hydrogen atom or a hydrocarbon group which has the same meaning as $R^1$ defined in the above-described polar group), singly or as a combination composed of any two or more atomic groups selected from the above groups.

Further, a preferred embodiment of the dispersion-stabilizing resin (P) is a resin having a polymerizable functional group which is copolymerizable with the monomer (A) bonded to at least one terminal of the polymer main chain. (The resin of this type is hereinafter sometimes specifically referred to as dispersion-stabilizing resin (PB) or resin (PB).)

Examples of the polymerizable functional group of the dispersion-stabilizing resin (PB) include the functional group represented by the general formula (VII) described for the polymerizable functional group in the above-described polyfunctional monomer (D).

Also, the polymerizable functional group may be bonded to one terminal of the polymer main chain directly or via an appropriated linking group. The linking group can be the same as that described for the dispersion-stabilizing resin (PA).

The weight average molecular weight of the dispersion-stabilizing resin (P) (including the resins (PA) and (PB)) of the present invention is preferably from $1\times10^4$ to $1\times10^6$, and more preferably from $2.5\times10^4$ to $2\times10^5$. If the weight average molecular weight is below $1\times10^4$, the average grain diameter of the resin grain obtained by the polymerization-granulation becomes large (e.g., more then 0.5 μm) and the distribution of the grain diameter becomes broad. Also, if it exceeds $1\times10^6$, the average grain diameter of the resin grain obtained by the polymerization-granulation becomes large thereby making it difficult to obtain grains having a uniform average grain diameter within a preferred range of from 0.15 to 0.4 μm.

The dispersion-stabilizing resin (P) used in the present invention is soluble in an organic solvent and, specifically, it may have a solubility of at least 5 parts by weight per 100 parts by weight of toluene at 25° C.

The dispersion-stabilizing resin (P) used in the present invention can be easily and preferably prepared by a conventional method comprising polymerizing the monomer corresponding to the repeating unit represented by the general formula (III) in the presence of at least the above-described polyfunctional monomer using a polymerization initiator (e.g., an azobis type compound or a peroxide).

The polymerization initiator can be used in an amount of from 0.5 to 15 wt % preferably from 1 to 10 wt %, per 100 parts by weight of the total monomers.

The dispersion-stabilizing resin (PA) which is a preferred embodiment of the present invention, in which the specific polar group is bonded to only one terminal of the polymer main chain, can easily be prepared by an ion polymerization process, in which a various kind of reagents is reacted at the terminal of a living polymer obtained by conventionally known anion polymerization or cation polymerization; a radical polymerization process, in which radical polymerization is performed in the presence of a polymerization initiator and/or a chain transfer agent which contains the specific polar group in the molecule thereof; or a process in which a polymer having a reactive group (for example, an amino group, a halogen atom, an epoxy group, and an acid halide group) at the terminal obtained by the above-described ion polymerization or radical polymerization is subjected to a polymer reaction to convert the terminal reactive group into the specific polar group.

Specifically, reference can be made to, e.g., P. Dreyfuss and R. P. Quirk, *Encycl. Polym. Sci. Eng.*, 7, 551 (1987), Yoshiki Nakajo and Yuya Yamashita, *Senryo to Yakuhin* (*Dyes and Chemicals*), 30, 232 (1985), Akira Ueda and Susumu Nagai, *Kagaku to Kogyo* (*Science and Industry*), 60, 57 (1986) and the literature references cited therein.

More specifically, the dispersion-stabilizing resin (PA) used in the present invention can be prepared by (1) a method comprising polymerization of a mixture of the monomer corresponding to the repeating unit represented by the general formula (II), the above-described polyfunctional monomer and a chain transfer agent containing the above-described specific polar group, using a polymerization initiator (e.g., an azobis compound, a peroxide, etc.), (2) a method comprising the above polymerization but using a polymerization initiator containing the polar group in place of the chain transfer agent, (3) a method of using compounds containing the polar groups as the chain transfer agent and the polymerization initiator, or (4) a method comprising the polymerization according to the method (1), (2) or (3) above in which compounds containing an amino group, a halogen atom, an epoxy group, an acid halide as a substituent are used as chain transfer agent and polymerization initiator, followed by introducing the polar group by reacting with these functional groups.

Specific examples of chain transfer agents which can be used include mercapto compounds containing the polar group or the reactive group capable of being converted into the polar group (e.g., thioglycolic acid, thiomalic acid, thiosalicylic acid, 2-mercaptopropionic acid, 3-mercaptopropionic acid, 3-mercaptobutyric acid, N- (2-mercaptopropionyl) glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, 2-mercapto-3-pyridinol, and alkyl iodide compounds containing the polar group or the polar group-forming reactive group (e.g., iodoacetic acid, iodopropionic acid, 2-iodoethanol, 2-iodoethanesulfonic acid, and 3-iodopropanesulfonic acid), preferably a mercapto compound.

Specific examples of the polymerization initiators containing the polar group or the substituent which can be converted into the polar group include 4,4'-azobis(4-cyanovaleric acid), 4,4'-azobis(4-cyanovaleric acid chloride), 2,2'-azobis(2-cyanopropanol), 2,2'-azobis (2-cyanopentanol), 2,2'-azobis[2-(5-hydroxy-3,4,5,6-tetrahydropyrimidin-2-yl)propane, 2,2'-azobis{2-methyl-N-[1,1-bis(hydroxymethyl)-2-hydroxyethyl]propionamide}, 2,2'-azobis{2-methyl-N-[1,1-bis(hydroxymethyl)ethyl]propioamide}, 2,2'-azobis[2-methyl-N-(2-hydroxyethyl)propionamide], and 2,2'-azobis(2-amidinopropane).

The chain transfer agent or polymerization initiator is usually used in an amount of from 0.1 to 15 parts by weight, preferably from 0.5 to 10 parts by weight.

Further, the dispersion-stabilizing resin (PB) having a polymerizable double bond group bonded to at least one terminal of the polymer main chain which is a preferred embodiment of the present invention can be easily be prepared by reacting a reagent containing a double bond group with a living polymer obtained by the conventional anion polymerization or cation polymerization at the terminal of the living polymer, or by reacting a reagent containing a specific reactive group (e.g., —OH, —COOH, —$SO_3H$, —SH, —$NH_2$, —$PO_3H_2$, —NCO, —NCS,

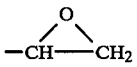

—COCl, and —$SO_2Cl$) with the living polymer at the terminal and then introducing a polymerizable double bond group by polymer reaction (i.e., a method by ion polymerization), or by performing a radical polymerization using a polymerization initiator and/or a chain transfer agent containing the above specific reactive group in the molecule and then introducing a polymerizable double bond group thereto by performing a polymer reaction utilizing the specific reactive group bonded to only one terminal of the polymer main chain thereby introducing the polymerizable double bond group into the polymer.

Specifically, the polymerizable double bond group can be introduced into the polymer according to the methods described, for example, in P. Dreyfuss & R.P. Quirk, *Encycl. Polymer Sci. Eng.*, 7, 551 (1987), Yoshiki Nakajo and Yuya Yamashita, *Senryo to Yakuhin(Dyes and Chemicals)*, 30, 232 (1985), Akira Ueda and Susumu Nagai, *Kagaku to Kogyo (Science and Industry)*, 60 (1986), P.F. Rempp & E. Franta, *Advances in Polymer Science*, 58, 1 (1984), Koichi Ito, *Kobunshi Kako (Polymer Processing)*, 35, 262 (1986), V. Percec, *Applied Polymer Science*, 285, 97 (1984) and the literature references cited therein.

More specifically, a method for introducing the polymerizable double bond group by polymer reaction utilizing the specific polar group of the dispersion-stabilizing resin (PA) is preferred.

The dispersed resin grains (latex grains) used in the present invention can be generally produced by heat-polymerizing the dispersion-stabilizing resin (P), the monofunctional monomer (A), the monofunctional macromonomer (MA) or the oligomer (B), and the polyfunctional monomer (D) in a non-aqueous solvent in the presence of a polymerization initiator such as benzoyl peroxide, azobisisobutyronitrile, butyllithium, etc.

Specifically, the dispersed resin grains can be produced by (1) a method of adding a polymerization initiator to a solution of a mixture of the dispersionstabilizing resin (P), the monomer (A), the macromonomer (MA) or oligomer (B), and the monomer (D), (2) a method of adding dropwise the monomer (A), the macromonomer (MA) or oligomer (B), and the monomer (D), together with a polymerization initiator to a solution of the dispersion-stabilizing resin (P), (3) a method of adding a polymerization initiator and a part of the monomer (A), the macromonomer (MA) or oligomer (B) and the monomer (D) to a solution of the total amount of the dispersion-stabilizing resin (P) and the remaining part of the monomer (A), the macromonomer (MA) or oligomer (B), and monomer (D), (4) a method of adding a solution of the dispersion-stabilizing resin (P) and the monomer (A), the macromonomer (MA) or oligomer (B), and the monomer (D) together with a polymerization initiator to a non-aqueous solvent.

The total amount of the monomer (A), the macromonomer (MA) or oligomer (B), and the monomer (D) is from about 5 to 80 parts by weight, and preferably from 10 to 50 parts by weight per 100 parts by weight of the non-aqueous solvent.

Also, the amount of the dispersion-stabilizing resin (P) which is a soluble resin is preferably from 1 to 100 parts by weight, and more preferably from 10 to 50 parts by weight per 100 parts by weight of the total amount of the monomers used including the macromonomer (MA), if any.

A suitable amount of the polymerization initiator is from 0.1 to 5% by weight of the total amount of the monomers used including the macromonomer (MA), if any.

The polymerization temperature is from about 50° C. to 180° C., and preferably from 60° C. to 120° C. The reaction time is preferably from 1 to 15 hours.

When a polar solvent such as alcohols, ketones, ethers, esters, etc., is used together with the non-aqueous solvent for the above-described reaction or when unreacted monomer (A) and/or (D) remain without being polymerization-granulated, it is preferred to remove the polar solvent or the unreacted monomers by heating the reaction mixture to the boiling point of the solvent or the monomers to distil off them or distil off the solvent or the monomers under reduced pressure.

The latex grains dispersed in a non-aqueous solvent thus produced exist as fine grains having a uniform grain size distribution and show a very stable dispersibility. In particular, when the liquid developer composed of the latex grains are repeatedly used in a developing device for a long period of time, the dispersibility thereof is good and the occurrence of aggregation or precipitation of the grains in the developing device is not observed.

Also, when the latex grains are fixed by heating, etc., a strong coating or layer having an excellent fixing property can be formed.

Further, the liquid developer of the present invention, when used in the plate-making system, shows excellent resistivity of the toner image after subjecting to the treatment for hydrophilization of the non-image area, and shows excellent reproducibility of the original image in the image area of prints.

The insoluble resin grain of the present invention has an improved monodispersibility and re-dispersibility of grains by polymerization-granulation using the macromonomer (MA) or oligomer (B) and the dispersion-stabilizing resin (P).

Specifically, in the dispersed resin grain of the present invention, the dispersion-stabilizing resin (P) shows an interaction with an insoluble resin grain and is adsorbed on the insoluble resin grain. Since the dispersion-stabilizing resin adsorbed on the resin grain is soluble in the non-aqueous solvent, it brings about a so-called steric repulsive effect which is known to be effective for dispersion stabilizing of non-aqueous latex. Further, since the dispersion-stabilizing resin (P) is a soluble resin having a crosslinked structure, it has markedly improved affinity to the non-aqueous solvent, and the adsorbed resin (P) exists near the boundary surface of grains due to its crosslinked structure and is considered to improve the solvation near the boundary surface of the resin grains.

The above characteristic features of the resins according to the present invention are considered to markedly inhibit aggregation and precipitation of insoluble resin grains and markedly improve the re-dispersibility of the resin grains.

In the present invention, when the dispersion-stabilizing resin (PA) containing a specific polar group bonded to one terminal of the polymer main chain, which is a preferred embodiment of the present invention, is used, it is considered that an interaction between the dispersion-stabilizing resin and the insoluble resin grain is further improved and the effect for the dispersion stabilization described above is further improved due to high adsorbability of the resin (PA) onto the resin grains.

When the dispersion-stabilizing resin (PB) containing a polymerizable functional group bonded to one terminal of the polymer main chain, which is a further preferred embodiment of the present invention, the resin (PB) is copolymerized with the monomer (A) to be insolubilized, the macromonomer (MA), if any, and the monomer (D) during the dispersion-polymerization whereby the resin is bonded to the insoluble resin grain more effectively.

As described above, the use of the dispersion-stabilizing resin (P) improves the dispersion stability, and the use of the dispersion-stabilizing resin (PA) or (PB) provides the same degree of effects with a smaller amount of the dispersion-stabilizing resin and reduces the amount of the dispersion stabilizing resin which is not adsorbed onto the resin grain. This eliminates various problems caused by the concentration of the unadsorbed dispersion stabilizing resin during the repeated use of the liquid developer for a long period of time.

On the other hand, the insoluble resin grain of the present invention is characterized by a crosslinked structure formed by polymerization-granulation using the polyfunctional monomer (D).

Due to the crosslinked structure, it is possible to improve the resistivity to the treating solution (resistivity) after forming a toner image and subjecting to the hydrophilization processing for making a printing plate, and to reduce markedly the damage of the toner image portion.

Also, it is important from the standpoint of apparatus that the insoluble resin grain has a low glass transition point in order to fix the resin under mild conditions. The resins having a low glass transition point generally can be obtained by incorporating a polar structure such as an ester structure, an ether structure or an amido structure so as to be easily dissolved in the treating solution in the hydrophilization processing and, as a result, the toner portion on the image area has low resistivity. This undesirable phenomenon can be markedly suppressed by partially crosslinking the inside of the resin grain.

The dispersed resin grain of the present invention brings about the effect of the present invention by the above-described actions.

The liquid developer of the present invention may contain, if desired, a colorant. There is no specific restriction on the colorant being used, and any conventional pigments or dyes can be used as the colorant in the present invention.

In the case of coloring the dispersion resin itself, there is, for example, a method of coloring the dispersion resin by physically dispersing a pigment or dye in the dispersion resin and various pigments and dyes can be used. For example, there are a magnetic iron oxide powder, a lead iodide powder, carbon black, nigrosine, Alkali Blue, Hansa Yellow, quinacridone red, phthalocyanine blue, etc.

As another method of coloring the dispersion resin grains, the dispersion resin may be dyed with a desired dye, for example, as disclosed in JP-A-57-48738. As a still another method, a dye may be chemically bonded to the dispersion resin as disclosed, for example, in JP-A-53-54029 or a previously dye-containing monomer is used in the polymerization granulation to provide a dye-containing dispersion resin as disclosed, for example, in JP-B-44-22955. (The term "JP-B" as used herein means an "examined Japanese patent publication".).

Various additives may be added to the liquid developer for enhancing the charging characteristics or improving the image characteristics and they are specifically described in Yuji Harasaki, *Electrophototgraphy,* Vol. 16, No. 2, page 44.

Specific examples of these additives include metal salts of 2-ethylhexylsulfosuccinic acid, metal salts of naphthenic acid, metal salts of higher fatty acids, lecithin, poly(vinylpyrrolidone), copolymers containing a semi-maleic acid amide component, higher alcohols, polyethers and waxes, but the present invention is not limited thereto.

The amounts of the main components constituting the liquid developer of the present invention are further described below.

The amount of the toner grains consisting essentially of the dispersion resin and, if desired, a colorant is preferably from about 0.5 to 50 parts by weight per 1,000 parts by weight of the liquid carrier. If the amount thereof is less than about 0.5 part by weight, the image density formed may be not sufficient and, if the amount exceeds about 50 parts by weight, non-image portions are liable to be fogged. Further, the above-described liquid carrier-soluble resin for enhancing the dispersion stability may also be used, if desired, in an amount of from about 0.5 by weight to about 100 parts by weight per 1,000 parts by weight of the liquid carrier. Also, the charge-controlling agent as described above can be used preferably in an amount of from 0.001 part by weight to 1.0 part by weight per 1,000 parts by weight of the liquid carrier.

Furthermore, if desired, various additives may be added to the liquid developer and the total amount of these additives is restricted by the electric resistance of the liquid developer. That is, if the electric resistance of the liquid developer in a state of excluding the toner grains therefrom becomes lower than $10^9$ Ωcm, continuous tone images having good image quality are reluctant to obtain and, hence, it is necessary to control the amounts of additives in the range of not lowering the electric resistance than $10^9$ Ωcm.

The present invention is illustrated in greater detail with reference to the following examples, but the present invention is not to be construed as being limited thereto.

Production Example 1 of Macromonomer (MA): Macromonomer MA-1

A mixture of 100 g of methyl methacrylate, 5 g of 3-mercaptopropionic acid, and 200 g of toluene was heated to 75° C. with stirring under nitrogen gas stream and after adding thereto 1.0 g of 2,2'-azobis(isobutyronitrile) (A.I.B.N.), the reaction was carried out for 4 hours. After further adding thereto 0.5 g of A.I.B.N., the reaction was carried out for 3 hours, and after further adding thereto 0.3 g of A.I.B.N., the reaction was carried out for 3 hours. Then, 8 g of glycidyl methacrylate, 1.0 g of N,N-dimethyldodecylamine, and 0.5 g of t-butylhydroquinone were added to the reaction mixture, and the resulting mixture was stirred for 12 hours at 100° C. After cooling, the reaction mixture was reprecipitated from 2 liters of methanol to obtain 82 g of white powder. The number average molecular weight of the polymer obtained was 6,500.

Macromonomer MA-1:

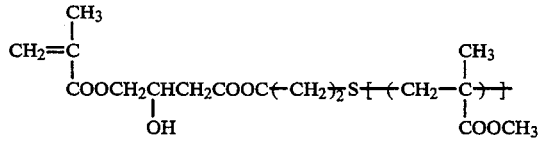

In the above formula as well as the formulae of macromonomers described below, the group represented by ⊣ ⊢ means a repeating unit.

Production Examples 2 to 39 of Macromonomer (MA): Macromonomers MA-2 to MA-39

Macromonomers MA-2 to MA-39 were prepared in the same manner as described in Production Example 1 of Macromonomer (MA) except for using each monomer corresponding to a repeating unit shown in Table 1 below in place of methyl methacrylate. The number average molecular weight of each of the macromonomers thus obtained was in the range of from 5,000 to 7,000.

TABLE 1

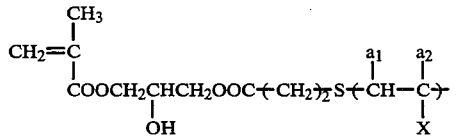

| Production Example of Macromonomer (MA) | Macromonomer (MA) | $a_1/a_2$ | X |
|---|---|---|---|
| 2 | MA-2 | —H/—$CH_3$ | $COOC_2H_5$ |
| 3 | MA-3 | " | $COOC_3H_7$(n) |
| 4 | MA-4 | " | $COOC_4H_9$(n) |
| 5 | MA-5 | —H/—$CH_3$ | $COOC_4H_9$(i) |

TABLE 1-continued

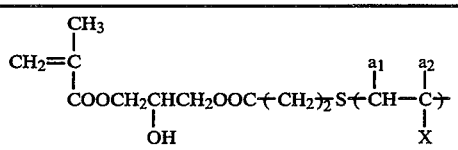

| Production Example of Macromonomer (MA) | Macromonomer (MA) | $a_1/a_2$ | X |
|---|---|---|---|
| 6 | MA-6 | " | $COOC_8H_{17}$ |
| 7 | MA-7 | " | $COOC_{12}H_{25}$ |
| 8 | MA-8 | " | $COOC_{13}H_{27}$ |
| 9 | MA-9 | " | $COOC_{16}H_{33}$ |
| 10 | MA-10 | " | $COOC_{18}H_{37}$ |
| 11 | MA-11 | —H/—H | $COOCH_3$ |
| 12 | MA-12 | " | $COOC_4H_9$ |
| 13 | MA-13 | " | $COOC_{12}H_{25}$ |
| 14 | MA-14 | " | $COOC_{18}H_{37}$ |
| 15 | MA-15 | $—CH_3/—H$ | $COOCH_3$ |
| 16 | MA-16 | " | $COOC_{10}H_{21}$ |
| 17 | MA-17 | —H/—H | 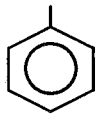 |
| 18 | MA-18 | —H/—H | CN |
| 19 | MA-19 | $—H/—CH_3$ | $\text{-}(CH_2)_2OCOCH_3$ |
| 20 | MA-20 | $—H/—CH_3$ | $\text{-}(CH_2)_2OCOC_4H_9$ |
| 21 | MA-21 | " | $\text{-}(CH_2)_2OCOC_9H_{19}$ |
| 22 | MA-22 | " | $\text{-}(CH_2)_2OCO(CH_2)_2COOC_2H_5$ |
| 23 | MA-23 | " | $\text{-}(CH_2)_2OCO(CH_2)_3COOCH_3$ |
| 24 | MA-24 | —H/—H | $\text{-}(CH_2)_2OCOCH{=}CH—COOC_5H_{11}$ |
| 25 | MA-25 | $—H/—CH_3$ | $—CH_2CH(OH)CH_2OOCC_3H_7$ |
| 26 | MA-26 | " | $—CH_2CH(OH)CH_2OOCC_5H_{11}$ |

TABLE 1-continued

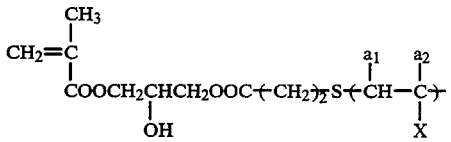

| Production Example of Macromonomer (MA) | Macromonomer (MA) | $a_1/a_2$ | X |
|---|---|---|---|
| 27 | MA-27 | " | $-CH(COOCH_3)CH_2COOCH_3$ |
| 28 | MA-28 | " | $-CH_2CH(OCOCH_3)CH_2OCOCH_3$ |
| 29 | MA-29 | $-H/-CH_3$ | $-CH_2CH(OCOC_3H_7)CH_2OCOC_3H_7$ |
| 30 | MA-30 | " | $-CH_2CH(OCOC_5H_{11})CH_2OCOC_5H_{11}$ |
| 31 | MA-31 | $-H/-H$ | $-CH_2CH(OCOC_6H_{13})CH_2OCOC_6H_{13}$ |
| 32 | MA-32 | $-H/-CH_3$ | $-CH_2CH(OCOCH_3)CH_2OCOC_5H_{11}$ |
| 33 | MA-33 | $-CH_3/-H$ | $-CH_2CH(OH)CH_2OOC(CH_2)_2COOC_3H_7$ |
| 34 | MA-34 | $-H/-CH_3$ | $-CH_2CH(OH)CH_2OOC(CH_2)_3COOCH_3$ |
| 35 | MA-35 | $-H/-H$ | $-CH_2CH(OCOCH_3)CH_2OOC(CH_2)_2COOC_3H_7$ |
| 36 | MA-36 | $-H/-CH_3$ | $-CH(COOC_3H_7)-CH_2COOC_3H_7$ |
| 37 | MA-37 | $-CH_3/-H$ | $-(CH_2)_2OCO(CH_2)_2SO_2C_4H_9$ |
| 38 | MA-38 | $-H/-H$ | $-(CH_2)_2OCO(CH_2)_2SO_2C_8H_{17}$ |
| 39 | MA-39 | $-H/-CH_3$ | $-(CH_2)_6OCOC_2H_5$ |

Production Example 40 of Macromonomer (MA): Macromonomer MA-40

A mixture of 96 g of 2,3-dipropoxypropyl methacrylate, 4 g of thioethanol, and 200 g of toluene was heated to 70° C. with stirring under nitrogen gas stream and after adding thereto 1.0 g of A.I.B.N., the reaction was carried out for 4 hours. Furthermore, after adding thereto 0.5 g of A.I.B.N., and the reaction was further carried out for 3 hours and, after further adding thereto 0.3 g of A.I.B.N., the reaction was carried out for 3 hours. The reaction mixture was cooled to room temperature and, after adding thereto 9.6 g of 2-carboxyethyl methacrylate, a mixture of 16.2 g of dicyclohexylcarbodiimide (D.C.C.) and 60 g of methylene chloride was added dropwise to the mixture over a period of one hour. Then, 1.0 g of t-butylhydroquinone was added to the mixture followed by stirring for 4 hours. Crystals formed were removed by filtration and the filtrate obtained was re-precipitated in 2 liters of methanol. An oily product thus precipitated was collected by decantation, dissolved in 150 ml of methylene chloride, and the solution was re-precipitated again from one liter of methanol to obtain an oily product. The product was then collected by filtration and dried under reduced pressure to obtain 54 g of a polymer having a number average molecular weight of $6.3\times10^3$.

Macromonomer MA-40:

-continued

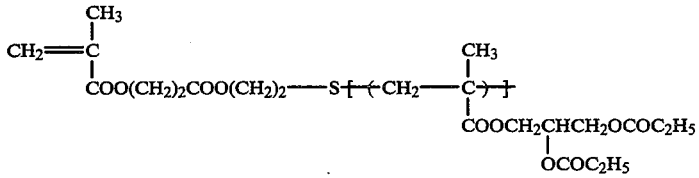

Production Examples 41 to 46 of Macromonomer (MA): Macromonomer MA-41 to MA-46

By following the same procedure as Production Example 40 of Macromonomer (MA) except that the methacrylate monomer (corresponding to 2,3-dipropoxypropyl methacrylate) and the unsaturated carboxylic acid (corresponding to 2-carboxyethyl methacrylate) used in Production Example 40 of Macromonomer were changed, each of the macromonomers shown in Table 2 below was produced. The number average molecular weight of each of the macromonomers thus obtained was in the range of from $5\times10^3$ to $8\times10^3$.

Production Example 47 of Macromonomer (MA): Macromonomer MA-47

A mixture of 100 g of 2,3-diacetoxypropyl methacrylate, 150 g of tetrahydrofuran, and 50 g of isopropyl alcohol was heated to 75° C. under a nitrogen gas stream. Then, after adding thereto 4.0 g of 4,4'-azobis(4-cyanovaleric acid) (A.C.V.), the reaction was carried out for 5 hours, and, after further adding thereto 1.0 g of A.C.V., the reaction was carried out for 4 hours. After cooling, the reaction mixture was re-precipitated from 1.5 liters of methanol and, the oily product formed was collected by filtration and dried under reduced pressure. The amount of the product was 85 g.

To 50 g of the oily product (oligomer) were added 15 g of glycidyl methacrylate, 1.0 g of N,N-dimethyldodecylamine, and 1.0 g of 2,2'-methylenebis(6-t-butyl-

TABLE 2

| Production Example of Macromonomer (MA) | Macromonomer (MA) | Chemical Structure of Macromonomer (MA) |
|---|---|---|
| 41 | MA-41 | 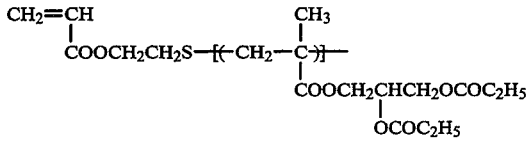 |
| 42 | MA-42 | 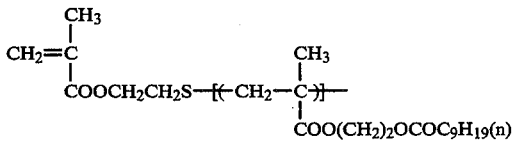 |
| 43 | MA-43 | 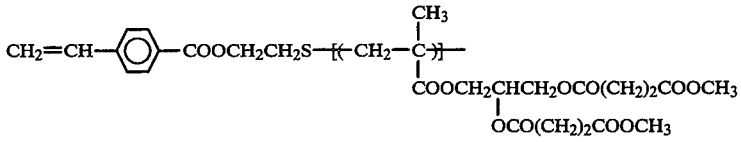 |
| 44 | MA-44 | 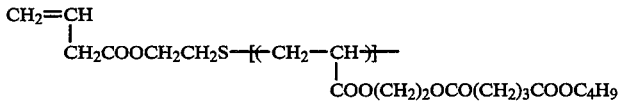 |
| 45 | M-45 | 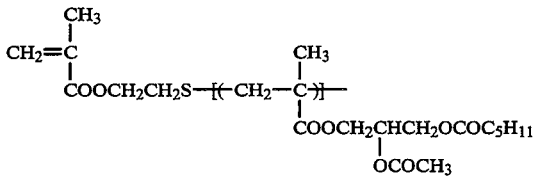 |
| 46 | M-46 | 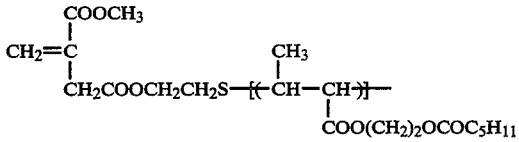 |

p-cresol), and the mixture was stirred for 15 hours at 100° C. After cooling, the reaction mixture was re-precipitated from one liter of petroleum ether to obtain 63 g of white powder. The number average molecular weight of the product was 6,200.

Macromonomer MA-47:

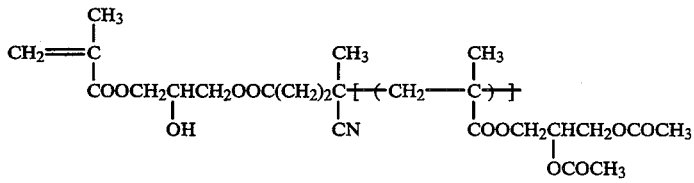

Production Example 1 of Oligomer (B): Oligomer B-1

A mixture of 100 g of 2,3-diacetoxypropyl methacrylate, 5 g of 3-mercaptopropionic acid, 150 g of toluene, and 50 g of methanol was heated to 50° C. with stirring under nitrogen gas stream. Then, after adding 1.5 g of 2,2'-azobis(isobutyronitrile) (A.I.B.N.) to the reaction mixture, the reaction was carried out for 4 hours and, after adding thereto 0.4 g A.I.B.N., the reaction was carried out for 4 hours. After cooling, the reaction mixture obtained was re-precipitated from 2 liters of a solvent mixture of methanol/water (4/1 by volume ratio) and, then, the methanol solution was separated by decantation. The viscous material thus formed was collected and dried to obtain 75 g of a colorless viscous product. The number average molecular weight of the oligomer obtained was 3,300.

Oligomer B-1

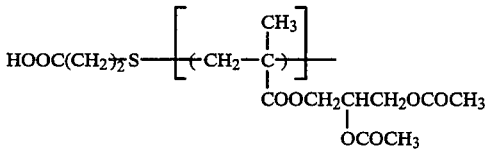

Production Examples 2 to 31 of Oligomer (B): Oligomers B-2 to B-31

By following the same procedure as Production Example 1 of Oligomer (B) except that each of the methacrylate monomers and mercapto compounds corresponding to the compounds shown in Table 3 below was used in place of 2,3-diacetoxypropyl methacrylate and 3-mercaptopropionic acid, respectively, each of Oligomers B-2 to B-31 was produced. The number average molecular weight of each of the oligomers obtained was in a range of from 2,500 to 5,000.

TABLE 3

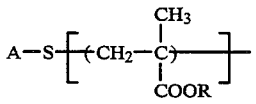

| Production Example of Oligomer (B) | Oligomer (B) | A— | —R |
|---|---|---|---|
| 2 | B-2 | $HOOC—CH_2—$ | $—CH_3$ |
| 3 | B-3 | $HOOC—CH(HOOC—CH_2)—$ | $—C_2H_5$ |
| 4 | B-4 | $HO(CH_2)_2—$ | $—(CH_2)_2OCOCH_3$ |
| 5 | B-5 | $H_2N(CH_2)_2—$ | $—C_{12}H_{25}$ |
| 6 | B-6 | $(CH_3)_2N—(CH_2)_2—$ | $—C_{13}H_{27}$ |
| 7 | B-7 | 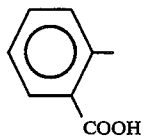 | $—(CH_2)_2OCOC_2H_5$ |
| 8 | B-8 | $HOCH_2CH(OH)CH_2—$ | $—C_4H_9$ |
| 9 | B-9 | $HO—P(=O)(OH)—O(CH_2)_2—$ | $—C_{18}H_{37}$ |

TABLE 3-continued

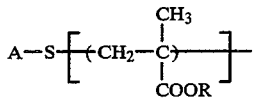

| Production Example of Oligomer (B) | Oligomer (B) | A— | —R |
|---|---|---|---|
| 10 | B-10 | 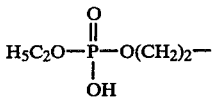 | $-C_{10}H_{21}$ |
| 11 | B-11 | 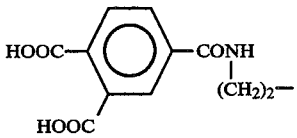 | $-CH_3$ |
| 12 | B-12 | 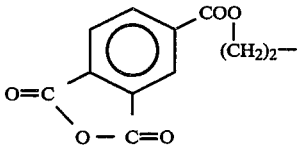 | $\leftarrow CH_2)_2COOCH_3$ |
| 13 | B-13 | 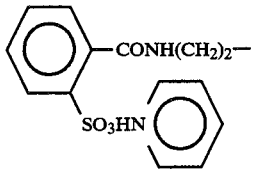 | $\leftarrow CH_2)_2COOC_4H_9$ |
| 14 | B-14 | 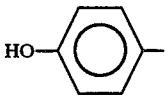 | $-CH_3$ |
| 15 | B-15 | $HOOC\leftarrow CH_2)_2$ <br> $\lvert$ <br> $CONH(CH_2)_2-$ | $-CH_2CHCH_2OCOCH_3$ <br> $\lvert$ <br> $OCOCH_3$ |
| 16 | B-16 | $HOOC(CH_2)_2-$ | $-CH_2CHCH_2OCOC_3H_7$ <br> $\lvert$ <br> $OCOC_3H_7$ |
| 17 | B-17 | $HOOC(CH_2)_2-$ | $-CH_2CHCH_2OCOC_5H_{11}$ <br> $\lvert$ <br> $OCOC_5H_{11}$ |
| 18 | B-18 | $HOOC(CH_2)_2-$ | $-CH_2CHCH_2OCOC_6H_{13}$ <br> $\lvert$ <br> $OCOC_6H_{13}$ |
| 19 | B-19 | $HOOC-CH-$ <br> $\lvert$ <br> $HOOC-CH_2$ | $\leftarrow CH_2)_2OCOC_9H_{19}$ |
| 20 | B-20 | $HOOC-CH-$ <br> $\lvert$ <br> $HOOC-CH_2$ | $\leftarrow CH_2)_2OCOC_7H_{15}$ |
| 21 | B-21 | $HOOC-CH-$ <br> $\lvert$ <br> $HOOC-CH_2$ | $\leftarrow CH_2)_2OCO$ <br> $\lvert$ <br> $(CH_2)_2COOCH_3$ |
| 22 | B-22 | 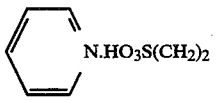 | $\leftarrow CH_2)_2OCO$ <br> $\lvert$ <br> $(CH_2)_3COOCH_3$ |

TABLE 3-continued

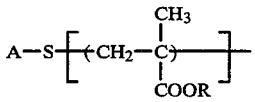

| Production Example of Oligomer (B) | Oligomer (B) | A— | —R |
|---|---|---|---|
| 23 | B-23 | $HOOC(CH_2)_2$— | $-(CH_2)_2OCO-(CH_2)_3COOC_2H_5$ |
| 24 | B-23 | $HOOC(CH_2)_2$— | $-(CH_2)_4COO(CH_2)_2OCH_3$ |
| 25 | B-25 | $HOOC(CH_2)_2$— | $-CH_2CH(OCOCH_3)CH_2OCOC_4H_9$ |
| 26 | B-26 | $HOOC(CH_2)_2$— | $-CH_2CH(OH)CH_2OCOC_2H_5$ |
| 27 | B-27 | $HOOC-CH(HOOC-CH_2)$— | $-CH_3$ |
| 28 | B-28 | $HOOC-CH(HOOC-CH_2)$— | $-CH(COOCH_3)-CH_2COOCH_3$ |
| 29 | B-29 | $HOOC-CH(HOOC-CH_2)$— | $-CH_2CH(OCOCH_3)CH_2OOC-(CH_2)_2-COOCH_3$ |
| 30 | B-30 | $HOOC-CH(HOOC-CH_2)$— | $-(CH_2)_2OCO(CH_2)_2-SO_2C_2H_5$ |
| 31 | B-31 | $HOOC-CH(HOOC-CH_2)$— | $-CH_2CH(OCO(CH_2)_2COOCH_3)CH_2OCOCH_3$ |

Production Example 32 of Oligomer (B): Oligomer B-32

A mixture of 100 g of 2-(n-nonylcarbonyloxy)ethyl crotonate, 150 g of toluene, and 50 g of ethanol was heated to 75° C. with stirring under nitrogen gas stream. Then, after adding 8 g of 4,4'-azobis(4-cyanovaleric acid) (A.C.V.) to the reaction mixture, the reaction was carried out for 5 hours and, after further adding thereto 2 g of A.C.V., the reaction was carried out for 4 hours. After cooling, the reaction mixture was re-precipitated from a mixture of methanol/water (4/1 by volume ratio) and, after separating the methanol solution by decantation, the viscous material formed was collected and dried. The amount of the oligomer was 70 g and the number average molecular weight was 2,600.

Oligomer B-32

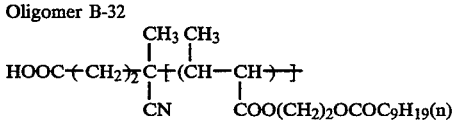

Production Examples 33 to 41 of Oligomer (B): Oligomers B-33 to B-41

By following the same procedure as Production Example 32 of Oligomer (B) except that each of the azobis compounds and the monomers corresponding to the repeating units shown in Table 4 below was used in place of A.C.V. as a polymerization initiator and 2-(n-nonylcarbonyloxy)ethyl crotonate, each of Oligomers B-33 to B-41 was produced. The number average molecular weight of each of the oligomers obtained was in a range of from 2,000 to 4,000.

TABLE 4

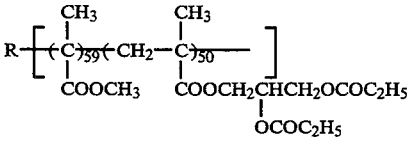

(weight ratio)

R—N=N—R: Azobis Compound

| Production Example of Oligomer (B) | Oligomer (B) | Azobis Compound: R— |
|---|---|---|
| 33 | B-33 | $HO-CH_2-C(CN)(CH_3)$— |
| 34 | B-34 | $HO-CH_2CH_2CH_2-C(CN)(CH_3)$— |

TABLE 4-continued

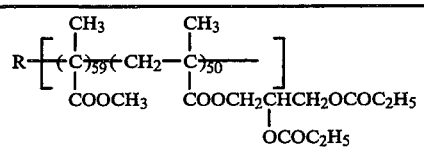

(weight ratio)

| Production Example of Oligomer (B) | Oligomer (B) | R—N=N—R: Azobis Compound<br>Azobis Compound: R— |
|---|---|---|
| 35 | B-35 | 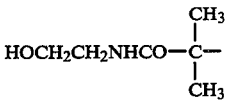 |
| 36 | B-36 | 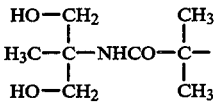 |
| 37 | B-37 | 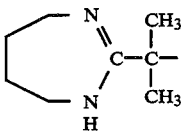 |
| 38 | B-38 | 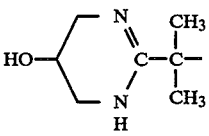 |
| 39 | B-39 | 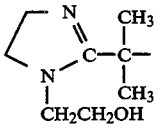 |
| 40 | B-40 | 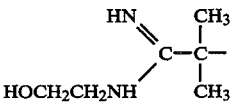 |

TABLE 4-continued

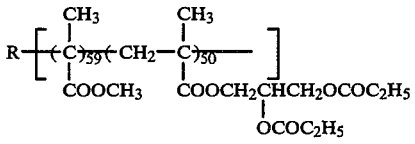

(weight ratio)

| Production Example of Oligomer (B) | Oligomer (B) | R—N=N—R: Azobis Compound<br>Azobis Compound: R— |
|---|---|---|
| 41 | B-41 | 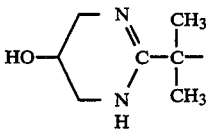 |

Production Example 1 of Dispersion-Stabilizing Resin (P): P-1

A mixed solution of 100 g of octadecyl methacrylate, 1.0 g of divinylbenzene and 200 g of toluene was heated to a temperature of 85° C. under nitrogen gas stream while stirring. 3.0 g of 2,2'-azobisisobutyronitrile (abbreviated as AIBN) was added thereto, followed by reacting for 4 hours, and 1.0 g of AIBN was further added thereto, followed by reacting for 2 hours. After cooling, the mixture was reprecipitated from 1.5 liter of methanol, and the resulting powder was collected by filtration and dried to obtain 88 g of the polymer as white powder. The resulting polymer had a weight average molecular weight (abbreviated as Mw) of $3.3\times10^4$.

Production Examples 2 to 14 of Dispersion-Stabilizinq Resin (P): P-2 to P-14

Each of the dispersion-stabilizing resins was prepared in the same manner as described in Production Example 1 of Dispersion-Stabilizing Resin (P) except for using Monomer (A) and Monomer (D) shown in Table 5 below in place of octadecyl methacrylate and divinylbenzene.

Each of the resulting resins had an Mw in the range of from $3\times10^4$ to $5\times10^4$.

TABLE 5

| Production Example | Dispersion-Stabilizing Resin (P) | Monomer (A) | | Monomer (D) | |
|---|---|---|---|---|---|
| 2 | P-2 | Dodecyl methacrylate | 100 g | Divinylbenzene | 0.8 g |
| 3 | P-3 | Tridecyl methacrylate | 100 g | Divinylbenzene | 0.7 g |
| 4 | P-4 | Octyl methacrylate<br>Dodecyl methacrylate | 20 g<br>80 g | Trivinyl benzene | 0.5 g |
| 5 | P-5 | Octadecyl methacrylate<br>Butyl methacrylate | 70 g<br>30 g | Ethylene glycol | 1.5 g |
| 6 | P-6 | Dodecyl methacrylate<br>N,N-Dimethylaminoethyl methacrylate | 95 g<br>5 g | Ethylene glycol | 0.9 g |
| 7 | P-7 | Octadecyl methacrylate<br>2-(Trimethoxysilyloxy)ethyl methacrylate | 96 g<br>4 g | Vinyl methacrylate | 1.2 g |
| 8 | P-8 | Hexadecyl methacrylate | 100 g | Divinylbenzene | 0.8 g |
| 9 | P-9 | Tetradecyl methacrylate | 100 g | Allyl methacrylate | 3.0 g |
| 10 | P-10 | Octadecyl methacrylate<br>Methacrylic acid | 95 g<br>5 g | Diethylene glycol dimethacrylate | 2.5 g |
| 11 | P-11 | Dodecyl methacrylate<br>Vinyl acetate | 90 g<br>10 g | Divinyl adipate | 4.0 g |
| 12 | P-12 | Octadecyl methacrylate<br>2-Hydroxyethyl methacrylate | 92 g<br>8 g | Triethylene glycol diacrylate | 3.0 g |
| 13 | P-13 | Dodecyl methacrylate | 80 g | Divinylbenzene | 0.9 g |

TABLE 5-continued

| Production Example | Dispersion-Stabilizing Resin (P) | Monomer (A) | | Monomer (D) |
|---|---|---|---|---|
| | | Styrene | 20 g | |
| 14 | P-14 | Dodecyl methacrylate | 92 g | |
| | | N-Vinylpyrrolidone | 8 g | |

Production Example 1 of Dispersion-Stabilizing Resin (PA): PA-1

A mixed solution of 97 g of octadecyl methacrylate, 3 g of thioglycolic acid, 5.0 g of divinylbenzene and 200 g of toluene was heated at a temperature of 85° C. under nitrogen gas stream while stirring. 0.8 g of 1,1'-azobis(-cyclohexane-1-carbonitrile) (abbreviated as ACHN) was added thereto, followed by reacting for 4 hours, and 0.4 g of ACHN was further added thereto, followed by reacting for 2 hours. Further, 0.2 g of ACHN was added thereto, followed by reacting for 2 hours. After cooling, the mixture was reprecipitated from 1.5 liter of methanol, and the resulting powder was collected by filtration and dried to obtain 88 g of the polymer as white powder. The resulting polymer had an Mw of $3\times10^4$.

Production of Examples 2 to 9 of Dispersion-Stabilizing Resin (PA): PA-2 to PA-9

Each of the dispersion-stabilizing resins was prepared in the same manner as described in Production Example 1 of Dispersion-Stabilizing Resin (PA) except for using Monomer (A) and Monomer (D) shown in Table 6 below in place of octadecyl methacrylate and divinylbenzene.

Each of the resulting resins had an Mw in the range of from $2.5\times10^4$ to $4\times10^4$.

TABLE 6

| Production Example | Dispersion-Stabilizing Resin (PA) | Monomer (A) | | Monomer (D) | |
|---|---|---|---|---|---|
| 2 | PA-2 | Dodecyl methacrylate | 97 g | Divinylbenzene | 6 g |
| 3 | PA-3 | Tridecyl methacrylate | 97 g | Divinylbenzene | 4 g |
| 4 | PA-4 | Octadecyl methacrylate | 17 g | Trivinylbenzene | 2.5 g |
| | | Dodecyl methacrylate | 80 g | | |
| 5 | PA-5 | Octadecyl methacrylate | 70 g | Ethylene glycol dimethacrylate | 8 g |
| | | Butyl methacrylate | 27 g | | |
| 6 | PA-6 | Dodecyl methacrylate | 92 g | Vinyl methacrylate | 10 g |
| | | N,N-dimethylaminoethyl methacrylate | 5 g | | |
| 7 | PA-7 | Octadecyl methacrylate | 93 g | Triethylene glycol diacrylate | 7 g |
| | | 2-(Trimethoxysilyloxy)ethyl methacrylate | 4 g | | |
| 8 | PA-8 | Hexadecyl methacrylate | 97 g | Divinyl adipate | 11 g |
| 9 | PA-9 | Tetradecyl methacrylate | 97 g | Polyethylene glycol #400 diacrylate | 12 g |

Production Example 10 of Dispersion-Stabilizing Resin (PA): PA-10

A mixed solution of 97 g of octadecyl methacrylate, 3 g of thiomalic acid, 4.5 g of divinylbenzene, 150 g of toluene and 50 g of methanol was reacted at a temperature of 60° C. under nitrogen gas stream while stirring. 0.5 g of AIBN was added thereto, followed by reacting for 5 hours, 0.3 g of AIBN was further added thereto, followed by reacting for 3 hours, and 0.2 g of AIBN was added thereto, followed by reacting for 3 hours. After cooling, the mixture was reprecipitated from 2 liters of methanol, and the resulting powder was collected by filtration and dried to obtain 85 g of the polymer as white powder. The resulting polymer had an Mw of $3.5\times10^4$.

Production Examples 11 to 16 of Dispersion-Stabilizing Resin (PA): PA-11 to PA-16

Each of the dispersion-stabilizing resins was prepared in the same manner as described in Production Example 10 of Dispersion-Stabilizing Resin (PA) except for using a mercapto compound shown in Table 7 below in place of 3 g of thiomalic acid.

TABLE 7

| Production Example | Dispersion-Stabilizing Resin (PA) | Mercapto Compound | Mw of Dispersion-Stabilizing Resin (PA) |
|---|---|---|---|
| 11 | PA-11 | $HS-CH_2CH_2COOH$ | $3.6\times10^4$ |
| 12 | PA-12 | $HS-CH_2CH_2SO_3H.N$ 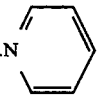 | $2.9\times10^4$ |
| 13 | PA-13 | 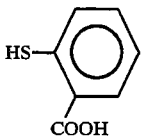 | $3.8\times10^4$ |
| 14 | PA-14 | $HS-CH_2CH_2-O-\overset{\overset{O}{\|}}{\underset{\underset{OH}{\|}}{P}}-OH$ | $3.3\times10^4$ |
| 15 | PA-15 | $HS-CH_2CH_2NHCO(CH_2)_2COOH$ | $3.7\times10^4$ |
| 16 | PA-16 | $HS-CH_2CH_2NHCH_2CH_2COOH$ | $3.5\times10^4$ |

Production Example 17 of Dispersion-Stabilizing Resin (PA): PA-17

A mixture of 94 g of hexadecyl methacrylate, 0.5 g of divinylbenzene, 150 g of toluene and 50 g of isopropyl alcohol was heated at a temperature of 90° C. under nitrogen stream, and 6 g of 2,2'-azobis(4-cyanovaleric acid) abbreviated as ACV) was added thereto, followed by reacting for 8 hours. After cooing, the reaction mixture was reprecipitated from 1.5 liter of methanol, and the resulting polymer as powder was collected by filtration and dried to obtain 83 g of white powder. The resulting polymer had an Mw of $6.5\times10^4$.

Production Example 18 of Dispersion-Stabilizing Resin (PA): PA-18

A mixture of 92 g of docosanyl methacrylate, 1.5 g of ISP-22GA (manufactured by Okamura Seiyu KK), 150 g of toluene and 50 g of ethanol was heated at a temperature of 80° C. under nitrogen stream, and 8 g of 4,4'-azobis(4-cyanopentanol) was added thereto, followed by reacting for 8 hours. After cooling, the reaction mixture was reprecipitated from 1.5 liter of methanol, and the resulting polymer as powder was collected by filtration and dried to obtain 78 g of white powder. The resulting polymer had an Mw of $4.1-10^4$.

Production Example 19 of Dispersion-Stabilizing Resin (PA): PA-19

A mixed solution of 95 g of octadecyl methacrylate, 5 g of 2-mercaptoethylamine, 5 g of divinylbenzene and 200 g of toluene was heated at a temperature of 85° C. under nitrogen stream, and, after adding 0.7 g of ACHN, the mixture was reacted for 8 hours.

Then, 8 g of glutaconic anhydride and 1 ml of concentrated sulfuric acid were added to the reaction mixture, followed by reacting for 6 hours at 100° C. After cooling, the reaction mixture was reprecipitated from 1.5 liter of methanol, and the resulting powder was collected by filtration and dried to obtain 83 g of a polymer as white powder. The resulting polymer had an Mw of $3.1\times10^4$.

Production Example 1 of Dispersion-Stabilizing Resin (PB): PB-1

A mixed solution of 50 g of Resin PA-1 prepared in Production Example 1 of Dispersion-Stabilizing Resin (PA), 5 g of allyl alcohol and 100 g of tetrahydrofuran was adjusted to a temperature of 25° C while stirring. To the solution was added dropwise a mixed solution of 8 g of dicyclohexylcarbodiimide (abbreviated as DCC), 0.2 g of 4-(N,N-diethylamino)pyridine and 20 g of methylene chloride over one hour. The mixture was allowed to react for 3 hours to complete the reaction. Then, 10 g of 80% formic acid was added to the reaction mixture, and, after stirring for one hour, insoluble materials were filtered off. The filtrate was reprecipitated from one liter of methanol, and the precipitate was collected by filtration and again dissolved in 90 g of toluene. After filtering off insoluble materials, the filtrate was reprecipitated from 500 ml of methanol, and the precipitate was collected by filtration and dried.

The yield of the resulting polymer was 32 g, and the polymer had an Mw of $3\times10^4$.

Production Examples 2 to 16 of Dispersion-Stabilizing Resin (PB): PB-2 to PB-16

Each of the dispersion-stabilizing resins was prepared in the same manner as described in Production Example 1 of Dispersion-Stabilizing Resin (PB) except for using Resin PA and the polymerizable group-introducing compound shown in Table 8 below in place of Resin PA-1 and allyl alcohol.

TABLE 8

| Production Example | Dispersion-Stabilizing Resin (PB) | Resin (PA) | Polymerizable Group-Introducing Compound | Mw of Dispersion-Stabilizing Resin (PB) |
|---|---|---|---|---|
| 2 | PB-2 | PA-2 | Allyl alcohol | $3.2\times10^4$ |
| 3 | PB-3 | PA-3 | Allyl alcohol | $3.5\times10^4$ |
| 4 | PB-4 | PA-4 | Allyl alcohol | $3.5\times10^4$ |
| 5 | PB-5 | PA-15 | Allyl alcohol | $3.7\times10^4$ |
| 6 | PB-6 | PA-16 | 1-Propenyl alcohol | $4.2\times10^4$ |
| 7 | PB-7 | PA-5 | Allylamine | $3\times10^4$ |
| 8 | PB-8 | PA-1 | 2-Hydroxyethyl methacrylate | $3\times10^4$ |
| 9 | PB-9 | PA-2 | 2-Hydroxyethyl methacrylate | $3.3\times10^4$ |
| 10 | PB-10 | PA-2 | 2-Hydroxyethyl acrylate | $3.5\times10^4$ |
| 11 | PB-11 | PA-8 | Allylamine | $3.2\times10^4$ |
| 12 | PB-12 | PA-9 | 4-Hydroxymethyl styrene | $3\times10^4$ |
| 13 | PB-13 | PA-8 | 1-Propenyl alcohol | $3.2\times10^4$ |
| 14 | PB-14 | PA-9 | Propargyl alcohol | $3\times10^4$ |
| 15 | PB-15 | PA-11 | Allyl alcohol | $3.5\times10^4$ |
| 16 | PB-16 | PA-11 | 2-Hydroxyethyl methacrylate | $3.6\times10^4$ |

Production Example 17 of Dispersion-Stabilizing Resin (PB): PB-17

A mixed solution of 94 g of octadecyl methacrylate, 3 g of 2-mercaptoethanol, 5 g of divinylbenzene, 150 g of tetrahydrofuran and 50 g of ethanol was heated at a temperature of 70° C. under nitrogen stream, and 1 g of AIBN was added thereto, followed by reacting for 4 hours. Then, 0.5 g of AIBN was further added thereto, followed by reacting for 4 hours.

The reaction mixture was cooled to 25° C., and 8 g of vinyl acetate was added thereto. To the mixture was added dropwise a mixed solution of 10 g of DCC, 0.4 g of 4-(N,N-diethylamino)pyridine and 30 g of methylene chloride over one hour, followed by stirring for 4 hours.

Then, 5 g of a 30% ethanol solution of hydrogen chloride and 5 g of water were added to the reaction mixture, followed by stirring for 1 hour. After filtering off insoluble materials, the filtrate was re-precipitated from 2 liters of methanol, and the precipitate was collected by filtration and dried. The resulting polymer had an Mw of $4\times10^4$.

Production Example 18 to 25 of Dispersion-Stabilizing Resin (PB): PB-18 to PB-25

Each of the dispersion-stabilizing resins was prepared in the same manner as described in Production Example 17 of Dispersion-Stabilizing Resin (PB) except for using the polymerizable group-containing carboxylic acid compound shown in Table 9 in place of vinyl acetate. Each of the resulting resins had an Mw of about $4\times10^4$.

TABLE 9

| Production Example | Dispersion-Stabilizing Resin (PB) | Polymerizable Group-Containing Carboxylic Acid Compound |
|---|---|---|
| 18 | PB-18 | Methacrylic acid |
| 19 | PB-19 | Acrylic acid |
| 20 | PB-20 | Crotonic acid |
| 21 | PB-21 | 4-Vinylbenzenecarboxylic acid |
| 22 | PB-22 | 3-Butenic carboxylic acid |
| 23 | PB-23 | $CH_2{=}C(CH_3)COO(CH_2)_2OCO(CH_2)_2COOH$ |
| 24 | PB-24 | $CH_2{=}CH\,COO(CH_2)_2OCO(CH_2)_3COOH$ |
| 25 | PB-25 | $CH_2{=}CH\,CONH(CH_2)_{10}COOH$ |

Production Example 26 of Dispersion-Stabilizing Resin (PB): PB-26

A mixture of 100 g of Resin PA-17 prepared in Production Example 17 of Dispersion-Stabilizing Resin (PA), 8 g of glycidyl methacrylate, 1.0 g of N,N-dimethyldodecylamine, 0.5 g of t-butylhydroquinone and 200 g of toluene was stirred at a temperature of 100° C. for 12 hours. After cooling, the reaction solution was reprecipitated in 1.5 liter of methanol, and the precipitate was collected by filtration and dried to obtain 78 g of a polymer as pale yellow powder. The resulting polymer had an Mw of $6.8\times10^4$.

Production Example 27 of Dispersion-Stabilizing Resin (PB): PB-27

A solution of 100 g of Resin PA-18 prepared in Production Example 18 of Dispersion-Stabilizing Resin (PA) dissolved in 200 g of tetrahydrofuran was cooled in a water bath to a temperature of 20° C., and 10.2 g of triethylamine was added to the mixture. Then, 14.5 g of methacrylic acid chloride was added dropwise thereto while stirring at a temperature of 25° C. or below. After completion of the addition, the mixture was stirred for one hour. Thereafter, 0.5 g of t-butylhydroquinone was added thereto, and the mixture was heated to a temperature of 60° C. and stirred for 4 hours. After cooling, the mixture was added dropwise to one liter of water while stirring over about 10 minutes. The mixture was stirred for one hour followed by allowing to stand, and water was removed by decantation. After washing with water twice, the product was dissolved in 100 ml of tetrahydrofuran and reprecipitated from 2 liters of petroleum ether. The precipitate was collected by decantation and dried under reduced pressure. The yield of the resulting viscous material was 65 g, and the Mw thereof was $4.5\times10^4$.

Production Example 1 of Latex Grain: D-1

A mixed solution of 8 g of Dispersion-Stabilizing Resin PB-18, 50 g of methyl methacrylates, 50 g of methyl acrylate, 1.0 g of Macromonomer MA-10, 3.5 g of ethylene glycol dimethacrylate, and 384 g of Isopar H was heated to 60° C. with stirring under nitrogen gas stream. Then, after adding thereto 0.8 g of 2,2'-azobis-(isovaleronitrile) (abbreviated as A.I.V.N.) as a polymerization initiator, the reaction was carried out for 3 hours. 20 minutes after the addition of the polymerization initiator, the reaction mixture became white-turbid and the reaction temperature raised to 88° C. Then, after adding 0.5 g of the polymerization initiator, followed by reacting for 3 hours, the temperature of the reaction mixture was raised to 100° C. and stirred to distil off unreacted vinyl acetate under reduced pressure of 30 mmHg. After cooling, the reaction mixture was passed through a 200 mesh nylon cloth to obtain the desired latex having a mean grain diameter of 0.22 μm with a polymerization ratio of 90% as a white dispersion. The grain diameter was determined using CAPA-500 (manufactured by Horiba Seisakujo KK), hereinafter the same.

Production Examples 2 to 21 of Latex Grain: D-2 to D-21

By following the same procedure as Production Example 1 of Latex Grain except that each of Dispersion-Stabilizing Resins, each of Macromonomers (MA) and each of Monomers (D) shown in Table 10 below were used in place of Dispersion-Stabilizing Resin PB-18, Macromonomer MA-10 and ethylene glycol dimethacrylate, each of Latex Grains D-2 to D-21 was produced.

Each of the resulting latex grains had a polymerization ratio of from 85 to 90%, a mean grain diameter of from 0.15 to 0.25 μm and good monodispersibility.

TABLE 10

| Production Example | Latex Grain | Dispersion-Stabilizing Resin | | Monomer (D) | | Macromonomer (MA) | |
|---|---|---|---|---|---|---|---|
| 2 | D-2 | P-2 | 20 g | Divinyl Gluconate | 4 g | MA-7 | 1.2 g |
| 3 | D-3 | P-3 | 20 g | Trimethylolethane Trimethacrylate | 3.5 g | MA-8 | 1.1 g |
| 4 | D-4 | P-4 | 22 g | Divinylbenzene | 3 g | MA-9 | 1.0 g |
| 5 | D-5 | P-11 | 18 g | Allyl Methacrylate | 5 g | MA-13 | 1.0 g |
| 6 | D-6 | PA-1 | 18 g | Divinyl Adipate | 4.5 g | MA-14 | 1.2 g |
| 7 | D-7 | PA-2 | 18 g | Divinyl Adipate | 4.5 g | MA-16 | 1.4 g |
| 8 | D-8 | PA-4 | 16 g | Vinyl Methacrylate | 3.5 g | MA-21 | 1.5 g |
| 9 | D-9 | PA-5 | 20 g | Propylene Glycol Dimethacrylate | 3.8 g | MA-22 | 1.3 g |
| 10 | D-10 | PA-8 | 25 g | Ethylene Glycol Diacrylate | 3 g | MA-28 | 1.0 g |
| 11 | D-11 | PA-12 | 20 g | Divinylbenzene | 3.5 g | MA-30 | 1.2 g |
| 12 | D-12 | PA-14 | 20 g | Divinylbenzene | 3.5 g | MA-35 | 1.0 g |
| 13 | D-16 | PA-16 | 22 g | Trivinylbenzene | 3 g | MA-38 | 1.4 g |
| 14 | D-14 | PB-1 | 8 g | Divinylbenzene | 4 g | MA-39 | 2.0 g |
| 15 | D-15 | PB-1 | 8 g | Trivinylbenzene | 4 g | MA-41 | 1.2 g |

TABLE 10-continued

| Production Example | Latex Grain | Dispersion-Stabilizing Resin | | Monomer (D) | | Macromonomer (MA) | |
|---|---|---|---|---|---|---|---|
| 16 | D-16 | PB-4 | 7 g | Trimethylolpropane Tiacrylate | 2 g | MA-42 | 0.8 g |
| 17 | D-17 | PB-6 | 8 g | Trimethylolethane Diacrylate | 1.8 g | MA-45 | 1.4 g |
| 18 | D-18 | PB-12 | 10 g | Trivinylbenzene | 3.5 g | MA-47 | 2.2 g |
| 19 | D-19 | PB-17 | 7 g | Ethylene Glycol Diacrylate | 2.8 g | MA-32 | 1.4 g |
| 20 | D-20 | PB-22 | 6 g | Ethylene Glycol Dimethacrylate | 3.2 g | MA-14 | 0.8 g |
| 21 | D-21 | PB-27 | 6 g | Trimethylolpropane Trimethacrylate | 2 g | MA-9 | 1.0 g |

Production Example 22 of Latex Grain: D-22

A mixed solution of 16 g of Dispersion-Stabilizing Resin P-1, 100 g of vinyl acetate, 1.6 g of Macromonomer MA-5, 5 g of divinyl adipate and 375 g of Isopar H was heated to 70° C. with stirring under nitrogen gas steam. Then, after adding 0.7 g of A.I.V.N. to the reaction mixture, the reaction was carried out for 4 hours and, after further adding thereto 0.5 g of A.I.V.N., the reaction was carried out for 4 hours. After cooling, the reaction mixture obtained was passed through a 200 mesh nylon cloth to obtain the desired latex grains having a mean grain size of 0.24 μm as a white dispersion with a polymerization ratio of 98%.

Production Examples 24 to 30 of Latex Grain: D-24 to D-30

A latex grain was prepared in the same manner as described in Production Example 23 of Latex Grain except for using each of the compounds shown in Table 11 below in place of Monomers (A) (i.e., methyl methacrylate and ethyl acrylate), Macromonomer MA-42, Dispersion-Stabilizing Resin PB-24 and Monomer (D) (i.e., ethylene glycol diacrylate) used in Production Example 23 of Latex Grain.

Each of the latex grains had a polymerization ratio of from 95 to 100%, a mean grain diameter in the range of from 0.20 to 0.35 μm and good monodispersibility.

TABLE 11

| Production Example | Latex Grain | Monomer (A) | | Dispersion-Stabilizing Resin | | Monomer (D) | | Macromonomer (MA) | |
|---|---|---|---|---|---|---|---|---|---|
| 24 | D-24 | Styrene | 40 g | PB-21 | 18 g | Ethylene Glycol Diacrylate | 3 g | MA-43 | 3.0 g |
| | | Methyl Methacrylate | 30 g | | | | | | |
| | | Ethyl Acrylate | 30 g | | | | | | |
| 25 | D-25 | Methyl Methacrylate | 60 g | PB-23 | 12 g | Ethylene Glycol Dimethacrylate | 4 g | MA-31 | 1.0 g |
| | | n-Propyl Methacrylate | 40 g | | | | | | |
| 26 | D-26 | Styrene | 60 g | PA-14 | 18 g | Divinyl Benzene | 2 g | MA-2 | 2.5 g |
| | | Vinyl Acetate | 40 g | | | | | | |
| 27 | D-27 | Vinyl Acetate | 40 g | PB-2 | 18 g | Divinyl Gluconate | 5 g | MA-40 | 2.5 g |
| | | Vinyl Benzoate | 60 g | | | | | | |
| 28 | D-28 | Methyl Methacrylate | 65 g | PB-16 | 14 g | Trimethylol-propane Triacrylate | 5 g | MA-44 | 1.8 g |
| | | Methyl Acrylate | 30 g | | | | | | |
| | | Methacrylic Acid | 5 g | | | | | | |
| 29 | D-29 | Vinyl Acetate | 90 g | PA-16 | 20 g | Trivinylbenzene | 1.5 g | MA-36 | 2.0 g |
| | | Vinyl Pyrrolidone | 10 g | | | | | | |
| 30 | D-30 | Vinyl Acetate | 95 g | PB-25 | 12 g | Trivinylbenzene | 1.5 g | MA-26 | 2.4 g |
| | | Crotonic Acid | 5 g | | | | | | |

Production Example 23 of Latex Grain: D-23

A mixed solution of 12 g of Dispersion-Stabilizing Resin PB-24 and 177 g of Isopar H was heated to 60° C. with stirring under nitrogen gas stream. Then, a mixed solution of 60 g of methyl methacrylate, 40 g of ethyl acrylate, 1.2 g of Macromonomer MA-42, 3 g of ethylene glycol diacrylate, 200 g of Isopar G and 1.0 g of A.I.V.N. was added dropwise to the reaction mixture over a period of 2 hours, and the resulting mixture was stirred for 2 hours. 0.5 g of A.I.V.N. was further added thereto, and the mixture was stirred for 3 hours. After cooling, the reaction mixture obtained was passed through a 200 mesh nylon cloth to obtain the desired latex having a mean grain size of 0.18 μm as a white dispersion with a polymerization ratio of 95%.

Production Example 31 of Latex Grain: Comparative Example A-1

By following the same procedure as Production Example 9 of Latex Grain except that 3.8 g of propylene glycol dimethacrylate as Monomer (D) was omitted, latex grains having a mean grain size of 0.21 μm were obtained with a polymerization ratio of 90% as a white dispersion (Latex disclosed in U.S. Pat. No. 5,049,468).

Production Example 32 of Latex Grain: Comparative Example B-1

By following the same procedure as Production Example 14 of Latex Grain except that 4 g of divinylbenzene as Monomer (D) was omitted, latex grains having mean grain size of 0.24 μm were obtained with a polymerization ratio of 93% as a white dispersion (Latex disclosed in U.S. Pat. No. 5,073,470). Production Example 33 of Latex Grain: Comparative Example C-1

By following the same procedure as Production Example 3 of Latex Grains except that 3.5 g of trimethylolethane triacrylate as Monomer (D) was omitted, latex grains having a mean grain size of 0.28 μm were obtained with a polymerization ratio of 90% as a white dispersion (Latex disclosed in JP-A-3-17663).

Production Example 101 of Latex Grain: D-101

A mixed solution of 14 g of Dispersion-Stabilizing Resin PB-23 and 177 g of Isopar H was heated to 60° C. with stirring under nitrogen gas stream. Then, a mixed solution of 50 g of methyl methacrylate, 50 g of methyl acrylate, 1.4 g of Oligomer B-18, 3 g of ethylene glycol diacrylate, 200 g of Isopar G and 1.0 g of A.I.V.N. was added dropwise to he reaction mixture over a period of 2 hours, and the resulting mixture was stirred for 2 hours. 0.5 g of A.I.V.N. was further added thereto, and the mixture was stirred for 3 hours. After cooling, the reaction mixture obtained was passed through a 200 mesh nylon cloth to obtain the desired latex having a mean grain size of 0.19 μm as a white dispersion with a polymerization ratio of 98%.

Production Examples 102 to 121 of Latex Grain: D-102 to D-121

By following the same procedure as Production Example 101 of Latex Grain except that each of Dispersion-Stabilizing Resins, each of Oligomer (B) and each of Monomers (D) shown in Table 12 below were used in place of Dispersion-Stabilizing Resin PB-23, Oligomer B-18 and ethylene glycol diacrylate, each of Latex Grains D-102 to D-121 was produced.

Each of the resulting latex grains had a polymerization ratio of from 90 to 98%, a mean grain diameter of from 0.15 to 0.25 μm and good monodispersibility.

TABLE 12

| Production Example | Latex Grain | Dispersion-Stabilizing Resin | | Oligomer (B) | | Monomer (D) | |
|---|---|---|---|---|---|---|---|
| 102 | D-102 | P-2 | 20 g | B-6 | 3 g | Ethylene Glycol Dimethacrylate | 3.0 g |
| 103 | D-103 | P-3 | 20 g | B-9 | 1.2 g | Ethylene Glycol Dimethacrylate | 3.0 g |
| 104 | D-104 | P-4 | 18 g | B-10 | 1.8 g | Divinylbenzene | 3 g |
| 105 | D-105 | P-11 | 20 g | B-17 | 1.4 g | Trimethylolethane Trimethacrylate | 4.5 g |
| 106 | D-106 | PA-1 | 18 g | B-25 | 2 g | Divinyl Adipate | 4.5 g |
| 107 | D-107 | PA-2 | 18 g | B-19 | 1.8 g | Divinyl Adipate | 4.5 g |
| 108 | D-108 | PA-4 | 16 g | B-32 | 1.4 g | Vinyl Methacrylate | 3.5 g |
| 109 | D-109 | PA-5 | 20 g | B-33 | 1.6 g | Trimethylolpropane Triacrylate | 4.2 g |
| 110 | D-110 | PA-8 | 18 g | B-36 | 1.8 g | Propylene Glycol Dimethacrylate | 4.2 g |
| 111 | D-111 | PA-12 | 24 g | B-29 | 2.0 g | Divinylbenzene | 3.5 g |
| 112 | D-112 | PA-14 | 16 g | B-20 | 1.6 g | Divinylbenzene | 3.5 g |
| 113 | D-113 | PA-16 | 18 g | B-5 | 1.8 g | Trivinylbenzene | 3 g |
| 114 | D-114 | PB-1 | 8 g | B-17 | 1.2 g | Divinylbenzene | 4 g |
| 115 | D-115 | PB-1 | 8 g | B-19 | 1.4 g | Trivinylbenzene | 4 g |
| 116 | D-116 | PB-4 | 7 g | B-22 | 1.2 g | Divinyl Adipate | 5 g |
| 117 | D-117 | PB-6 | 8 g | B-31 | 1.6 g | Vinyl Methacrylate | 4 g |
| 118 | D-118 | PB-12 | 10 g | B-32 | 1.0 g | Trivinylbenzene | 3.5 g |
| 119 | D-119 | PB-17 | 7 g | B-40 | 2.4 g | Ethylene Glycol Dimethacrylate | 2.8 g |
| 120 | D-120 | PB-22 | 6 g | B-18 | 1.0 g | Ethylene Glycol Dimethacrylate | 3.3 g |
| 121 | D-121 | PB-27 | 6 g | B-10 | 1.6 g | Trimethylolpropane Trimethacrylate | 3.8 g |

Production Example 122 of Latex Grain: D-122

A mixed solution of 16 g of Dispersion-Stabilizing Resin P-1, 100 g of vinyl acetate, 1.8 g of Oligomer B-32, 5 g of divinyl adipate, and 384 g of Isopar H was heated to 70° C. with stirring under nitrogen gas stream. Then, after adding thereto 0.8 g of 2,2'-azobis-(isovaleronitrile) (abbreviated as A.I.V.N.) as a polymerization initiator, the reaction was carried out for 3 hours. 20 minutes after the addition of the polymerization initiator, the reaction mixture became whiteturbid and the reaction temperature raised to 88° C. Then, after adding 0.5 g of the polymerization initiator, followed by reacting for 2 hours, the temperature of the reaction mixture was raised to 100° C. and stirred for 2 hours to distil off unreacted vinyl acetate. After cooling, the reaction mixture was passed through a 200 mesh nylon cloth to obtain the desired latex having a mean grain diameter of 0.22 μm with a polymerization ratio of 90% as a white dispersion.

Production Examples 123 to 129 of Latex Grain: D-123 to D-129

A latex grain was prepared in the same manner as described in Production Example 122 of Latex Grain except for using each of the compounds shown in Table 13 below in place of Monomers (A) (i.e., vinyl acetate), Oligomer B-32, Dispersion-Stabilizing Resin P-1 and Monomer (D) (i.e., divinyl adipate) used in Production Example 122 of Latex Grain.

Each of the latex grains had a polymerization ratio of from 85 to 95%, a mean grain diameter in the range of from 0.15 to 0.30 μm and good monodispersibility.

TABLE 13

| Production Example | Latex Grain | Monomer (A) | | Dispersion-Stabilizing Resin | | Oligomer (B) | | Monomer (D) | |
|---|---|---|---|---|---|---|---|---|---|
| 123 | D-123 | Styrene | 40 g | PA-13 | 20 g | B-18 | 1.4 g | Ethylene Glycol Dimethacrylate | 3 g |
| | | Methyl Methacrylate | 30 g | | | | | | |
| | | Ethyl Acrylate | 30 g | | | | | | |
| 124 | D-124 | Methyl Methacrylate | 60 g | PB-24 | 16 g | B-9 | 1.2 g | Ethylene Glycol | 4 g |
| | | n-Propyl Methacrylate | 40 g | | | | | | |
| 125 | D-125 | Styrene | 60 g | PB-21 | 10 g | B-7 | 2.0 g | Divinyl Benzene | 2 g |

TABLE 13-continued

| Production Example | Latex Grain | Monomer (A) | | Dispersion-Stabilizing Resin | | Oligomer (B) | | Monomer (D) | |
|---|---|---|---|---|---|---|---|---|---|
| | | Vinyl Acetate | 40 g | | | | | | |
| 126 | D-126 | Vinyl Acetate | 40 g | P-1 | 15 g | B-32 | 1.6 g | Divinyl Gluconate | 5 g |
| | | Vinyl Benzoate | 60 g | | | | | | |
| 127 | D-127 | Methyl Methacrylate | 65 g | P-23 | 20 g | B-6 | 2.0 g | Trimethylol-propane Triacrylate | 6 g |
| | | Methyl Acrylate | 30 g | | | | | | |
| | | Methacrylic Acid | 5 g | | | | | | |
| 128 | D-128 | Vinyl Acetate | 90 g | PA-17 | 20 g | B-30 | 1.0 g | Trivinylbenzene | 1.5 g |
| | | Vinyl Pyrrolidone | 10 g | | | | | | |
| 129 | D-129 | Vinyl Acetate | 95 g | PB-20 | 12 g | B-25 | 1.6 g | Trivinylbenzene | 1.5 g |
| | | Crotonic Acid | 5 g | | | | | | |

Production Example 130 of Latex Grain: Comparative Example A-2

By following the same procedure as Production Example 101 of Latex Grain except that 3 g of ethylene glycol diacrylate as Monomer (D) was omitted, latex grains having a mean grain size of 0 21 μm were obtained with a polymerization ratio of 90% as a white dispersion (Latex disclosed in U.S. Pat. No. 5,073,471).

Production Example 131 of Latex Grain: Comparative Example B-2

By following the same procedure as Production Example 102 of Latex Grain except that 3 g of ethylene glycol dimethacrylate as Monomer (D) was omitted, latex grains having a mean grain size of 0.24 μm were obtained with a polymerization ratio of 93% as a white dispersion (Latex disclosed in JP-A-3-18863).

Production Example 132 of Latex Grain: Comparative Example C-2

By following the same procedure as Production Example 9 of Latex Grain except that 4.2 g of trimethylolpropane triacrylate as Monomer (D) was omitted, latex grains having a mean grain size of 0 28 μm were obtained with a polymerization ratio of 90% as a white dispersion (Latex disclosed in U.S. Pat. No. 5,041,352).

EXAMPLE 1

In a paint shaker (manufactured by Tokyo Seiki K.K.) were placed 10 g of a dodecyl methacrylate/acrylic acid copolymer (95/5 by weight ratio), 10 g of nigrosine, and 30 g of Isopar G together with glass beads and they were dispersed for 4 hours to obtain a fine dispersion of nigrosine.

Then, a liquid developer for electrostatic photography was prepared by diluting 30 g of Latex Grain D-1 obtained in Production Example 1 of Latex Grain, 2.5 g of the above-prepared nigrosine dispersion, 15 g of branched chain octadecyl alcohol, FOC-1800 (trade name, made by Nissan Chemical Industries, Ltd.) and 0.07 g of an octadecene-octadecylamide semi-maleate copolymer with one liter of Isopar G.

Comparative Liquid Developers A-1 to C-1

Three kinds of Comparative Liquid Developers A-1 to C-1 were prepared in the same manner as above except that each of the resin dispersions (latex grains) shown below was used in place of Latex Grain D-1 used above.

Comparative Liquid Developer A-1

The latex grains obtained in Production Example 31 of Latex Grain were used.

Comparative Liquid Developer B-1

The latex grains obtained in Production Example 32 of Latex Grain were used.

Comparative Liquid Developer C-1

The latex grains obtained in Production Example 33 of Latex Grain were used.

These liquid developers were used for electrophotographic plate-making system to evaluate various characteristics. The results obtained are shown in Table 14 below.

TABLE 14

| | Example 1 | Comparative Example A-1 | Comparative Example B-1 | Comparative Example C-1 |
|---|---|---|---|---|
| Stain of Developing Apparatus[1)] | No toner residue adhered | No toner residue adhered | No toner residue adhered | No toner residue adhered |
| Image of the 2,000th Plate[1)] | Clear | Clear | Clear | Clear |
| Fixing Property of Image[2)] | Good | Good | Good | Good |
| Resistivity of Toner Image[3)] | Good | Fine lines and letter part lost | Fine lines and letter part lost | Fine lines and letter part lost |
| Printing Durability[4)] | 5,000 sheets | Poor from the start of printing | Poor from the start of printing | Poor from the start of printing |

The characteristics items described in Table 14 above were evaluated as follows:

1) Stains of Developing Apparatus and Image of the 2,000th Plate

An electrophotographic light-sensitive material, ELP Master II Type (trade name, made by Fuji Photo Film Co., Ltd.) was image-exposed and developed by a full-automatic processor, ELP 404V (trade name, made by Fuji Photo Film Co., Ltd.) using each of the liquid developers thus prepared. The processing (plate-making) speed was 7 plates/minute. Furthermore, after processing 2,000 plates of ELP Master II Type, the occurrence of stains of the developing apparatus by adhesion of the toner was observed. The blackened ratio (imaged area) of the duplicated images was determined using 30% original.

2) Fixing Property of Image

The liquid developer to be tested was used as a developer for the full-automatic processor ELP-404V, and the electrophotographic light-sensitive material P-1 prepared as described below was processed to obtain a printing plate. The resulting plate was then subjected to an abrasion testing machine, and the strength of the image area was visually evaluated. As a reference liquid developer, Liquid Developer ELP-T (trade name, made by Fuji Photo Film Co., Ltd.) which has practically sufficient fixing property was used.

Preparation of Electrophotographic Light-sensitive Material P-1

A mixture of 34 g of Binder Resin (B-1) having the following structure, 6 g of Binder Resin (B-2) having the following structure, 200 g of photoconductive zinc oxide, 0.03 g of uranine, 0.06 g of Rose Bengal, 0.02 g of tetrabromophenol blue, 0.30 g of phthalic anhydride, 0.01 g of o-chlorophenol and 300 g of toluene was dispersed by a homogenizer (manufactured by Nippon Seiki K.K.) at a rotation of $1\times10^4$ r.p.m. for 10 minutes to prepare a coating composition for a light-sensitive layer. The coating composition was coated on paper, which had been subjected to electrically conductive treatment, by a wire bar at a dry coverage of 26 g/m$^2$, followed by drying at 100° C. for 30 seconds. The coated material was then heated at 120° C. for one hour and allowed to stand in a dark place at 20° C. and 65% RH for 24 hours to prepare an electrophotographic light-sensitive material P-1.

Binder Resin (B-1)

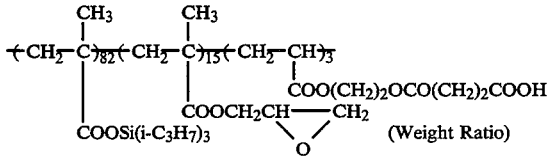

Mw: 40,000

Binder Resin (B-2)

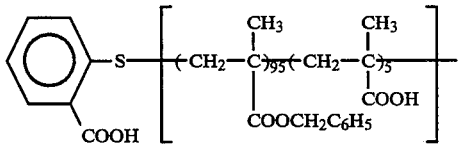

Mw: 8,000

3) Resistivity of Toner Image

The plate prepared under the same plate-making conditions as described in 2) above was once passed through an etching machine using Oil-desensitizing Solution ELP-EX (trade mark, made by Fuji Photo Film Co., Ltd.) and the immersed in Oil-desensitizing Solution E-1 for the binder resins of the photoconductive layer having the following formulation for 5 minutes. Thereafter, the plate was washed with water and dried.

The image area of the resulting printing plate was observed by an optical microscope, and the presence of any damages in the image area was visually evaluated.

Preparation of Oil-desensitizing Solution E-1

80 g of monoethanol amine, 8 g of Newcol B4SN (manufactured by Nippon Nyukazai KK) and 100 g of benzyl alcohol were dissolved in distilled water to make a total volume of 1 liter, and pH was adjusted to 11.0 with potassium hydroxide to prepare Oil-desensitizing Solution E-1.

4) Printing Durability

The master plate prepared and oil-desensitized in the same manner as described in 3) above was subjected to printing using, as dampening water, a solution prepared by diluting by 20 times Oil-desensitizing Solution E-1 with distilled water and a printing machine, Hamada Star 800SX (manufactured by Hamada Star KK) on neutral papers as a print paper. The resulting print was evaluated by counting a number of prints which could be obtained without the occurrence of any lack of image areas.

As is noted from the results shown in Table 14, the liquid developers of the present invention, and Comparative Examples A-1 to C-1 showed good results without causing stains of the developing apparatus and providing clear images, which indicate good dispersibility and redispersibility of resin grains.

Also, when the mechanical strength of toner images was evaluated by subjecting the toner images to forced abrasion, each of the toner grains was found to be good condition. That is, the grain of the present invention was found to have practically sufficient fixing property.

Further, the plate was tested under forced conditions to determine whether the image areas were sufficiently resisted by the toner layer and whether the image areas were not damaged when zinc oxide and the binder resin B-1 in the non-image areas were chemically treated to render the non-image areas hydrophilic. As a result, it was found that the toner grains other than that of the present invention were lost in fine parts of the toner image areas such as fine lines and fine letters.

Also, when the plate was processed under conventional oil-desensitizing treatment conditions and was then used for printing as an offset master plate, only the plate developed with the liquid developer according to the present invention provided clear prints even after printing 5,000 prints.

On the other hand, with the developers of Comparative Examples A-1 to C-1, the decreased reproducibility of the duplicated image during the plate-making also appeared in prints, and failures of fine lines and fine letters occurred from the start of printing.

The above results indicated that only the liquid developers according to the present invention provide excellent dispersibility, redispersibility and printing durability in the electrophotographic plate-making system utilizing an electrophotographic light-sensitive material having an improved printing properties.

EXAMPLE 2

A liquid developer for electrostatic photography was prepared by diluting 30 g of Latex Grain D-22 prepared in Production Example 22 of Latex Grain, 10 g of branched hexadecyl alcohol, FOC-1600 (trade name, made by Nissan Chemical Industries, Ltd.) and 0.06 g of an octadecylvinyl ether/dodecylamide semi-maleate copolymer with one liter of Isopar G.

Comparative Liquid Developers D-1 and E-1

Two kinds of Comparative Liquid Developers D-1 and E-1 were prepared in the same manner as above except that each of the resin dispersions (latex grains) shown below was used in place of Latex Grain D-22 used above.

Comparative Liquid Developer D-1

The latex grains obtained in Production Example 31 of Latex Grain were used.

Comparative Liquid Developer E-1

The latex grains obtained in Production Example 32 of Latex Grain were used.

These liquid developers were used for electrophotographic plate-making system to evaluate various characteristics. The results obtained are shown in Table 15 below.

TABLE 15

| | Example 2 | Comparative Example D-1 | Comparative Example E-1 |
|---|---|---|---|
| Stains of Developing Apparatus | No toner residue adhered | No toner residue adhered | No toner residue adhered |
| Image of the 2,000th Plate | Clear | Clear | Clear |
| Resistivity of Toner Image[5)] | Good | Fine lines and letter part lost | Fine lines and letter part lost (dissolved out) |
| Printing Durability[6)] | More than 100,000 sheets | Fine lines and letter part lost from the start of printing | Fine lines and letter part lost from the start of printing |

In Table 15, the stains of developing apparatus and the image of the 2,000th plate were evaluated in the same manner as described in Example 1. Other characteristic items in Table 16 were evaluated as follows:

5) Resistivity of Toner Image

The electrophotographic light-sensitive material P-2 prepared as described below was charged to a surface potential of +450 V in a dark place. The plate was then b exposed at a pitch of 25 μm and a scanning speed of 300 m/sec under irradiation of 60 erg/cm$^2$. on the surface of the light-sensitive material using a gallium-aluminum-arsenic semiconductor laser (oscillation wavelength: 780 nm) with an output of 2.8 mW as a light source, and developed with each of the liquid developers while applying bias potential of 30 V to the opposite electrodes to obtain a toner image on the plate. The plate was then heated at 100° C. for one minute to fix toner image.

Preparation of Electrophotographic Light-sensitive Material P-2

1.9 part by weight of X type non-metal phthalocyanine (made by Dainippon Ink Co., Ltd.) as an organic photoconductive compound, 0.15 part by weight of a thiobarbituric acid compound having the following structure as an additive, 17 parts by weight of Binder Resin B-3 having the following structure, and 100 parts by weight of a mixed solution of tetrahydrofuran/cyclohexane (8/2 by weight) were placed in a 500 ml glass vessel together with glass beads. After dispersing the mixture in a paint shaker for 60 minutes, glass beads were filtered off to prepare a dispersion for the photoconductive layer.

Then, the resulting dispersion was coated on a grained aluminum plate having a thickness of 0.25 mm and dried to prepare an electrophotographic printing plate precursor having a photoconductive layer of 6.0 μm dry coating thickness.

Thiobarbituric Acid Compound

-continued

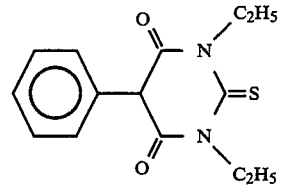

Binder Resin (B-3)

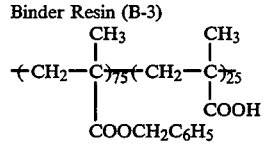

Mw: 40,000

Each of the printing plate precursors were immersed in Oil-desensitizing Solution E-2 having the following composition to remove the photoconductive layer in the non-image areas. The plate was washed with water and air-dried by a drier.

| Composition of Oil-desensitizing Solution E-2 | |
|---|---|
| Potassium silicate | 40 g |
| Potassium hydroxide | 10 g |
| Ethanol | 100 g |
| Water | 800 g |

The image areas of the resulting printing plate was visually evaluated through a 60-fold magnifying glass (made by PEAK Co., Ltd.) to determine the presence of loss of fine lines and fine letters.

6) Printing Durability

The master plate for offset printing prepared from each of the light-sensitive material under the same conditions as in 5) above was subjected to a gumming treatment and mounted on an offset printing machine (Oliver 52 Type manufactured by Sakurai Seisakusho KK) to print on high quality paper. A number of prints which could be obtained without occurrence of background stain in the non-image area and deterioration of image quality in the image area of the print was counted. (The higher the number of prints shows the better the printing durability.)

As is noted from the results shown in Table 15, the liquid developers of the present invention and Comparative Developers D-1 and E-1 showed good re-dispersibility and good image on the plate after printing 2,000 sheets.

Then, the plate obtained after plate-making was treated with an alkaline processing solution to dissolve out the non-image area to obtain a master plate for offset printing. At this point of time, Comparative Examples D-1 and E-1 causes loss of a small area portion of the toner image such as fine lines and fine letters. This indicates that the resistivity of the toner layer to the processing solution is not sufficient whereby the image area is dissolved out during the processing. On the other hand, with the developer of the present invention, the above adverse effect was not observed and showed sufficient resistivity.

Further, when the plate was used for printing as an offset master, the plate developed with a developer according to the present invention provided prints having a clear image even after printing 100,000 sheets. However, with Comparative Examples D-1 and E-1, the image of prints was deteriorated from the start of printing, and prints having a satisfactory image could not be obtained, since Comparative Examples D-1 and E-1 did not provide sufficient resistivity to the processing solution for dissolving out the non-image area and, thus, these developers did not provide image reproducibility sufficient for an offset master plate.

The above results indicate that only the liquid developer according to the present invention provide satisfactory dispersibility, redispersibility and printing durability in the electrophotographic plate-making system wherein the printing plate is prepared by dissolving out the non-image area of the electrophotographic light-sensitive material.

EXAMPLE 3

In a paint shaker (manufactured by Tokyo Seiki K.K.) were placed 10 g of a copolymer of tetradecyl methacrylate/acrylic acid (95/5 by weight ratio), 10 g of nigrosine, and 30 g of Isopar G together with glass beads followed by dispersing for 4 hours to obtain a fine dispersion of-nigrosine.

Then, a liquid developer for electrostatic photography was prepared by diluting 30 g of Latex Grain D-23 obtained in Production Example 11 of Latex Grain, 2.5 g of the above-prepared nigrosine dispersion, 0.06 g of a copolymer of hexadecene and octadecylamide semimaleate and 20 of of FOC-1800 (trade name of octadecyl alcohol, made by Nissan Chemical Industries, Ltd.), with one liter of Isopar G.

The resulting liquid developer of the present invention was evaluated for the stains of the developing apparatus and the image of the 2,000th plate under the same conditions as in 1) of Example 1, and good results similar to those of Example 1 were obtained.

Then, the electrophotographic light-sensitive material P-3 prepared as described below was charged to −6 kV in a dark place. The plate was then exposed at a pitch of 25 μm and a scanning speed of 330 m/sec under irradiation of 45 erg/cm$^2$ on the surface of the light-sensitive material using a gallium-aluminum-arsenic semiconductor laser (oscillation wavelength: 780 nm) with an output of 2.0 mW as a light source, and developed with the liquid developer of the present invention. The plate was then heated at 60° C. for 30 seconds to obtain a toner image.

Preparation of Electrophotographic Liqht-sensitive Material P-3

A mixture of 25 g of Binder Resin B-4 having the following formula, 9 g of Binder Resin B-5 having the following formula, 6 g of Binder Resin B-6 having the following formula, 200 g of photoconductive zinc oxide, 0.3 g of phthalic anhydride, 0.01 g of phenol, 0.018 g of Cyanine Dye A having the following structure and 300 g of toluene was dispersed in a homogenizer at a rotation of $1\times10^4$ r.p.m. for 10 minutes to prepare a coating composition for a light-sensitive layer. The resulting composition was coated on paper, which had been subjected to electrically conductive treatment, by a wire bar at a dry coverage of 25 g/m$^2$, followed by drying at 100° C. for 20 seconds and then heating at 120° C. for 1 hour. The coated material was allowed to stand in a dark place at 20° C. and 65% relative humidity (RH) for 24 hours to prepare an electrophotographic light-sensitive material P-3.

Binder Resin (B-4)

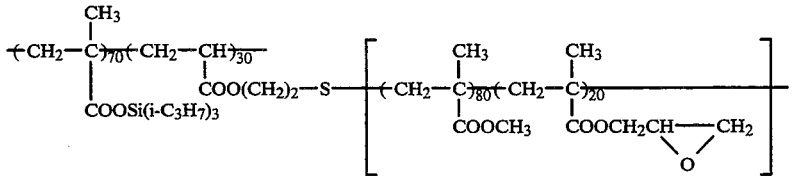

Binder Resin (B-5)

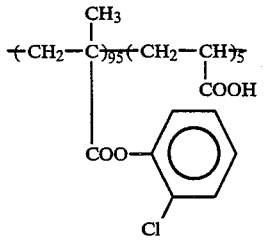

Mw: 8,000

Binder Resin (B-6)

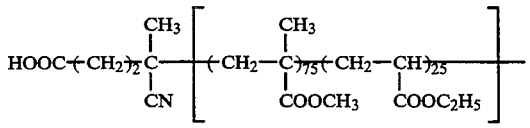

Mw: 65,000

Cyanine Dye (A)

-continued

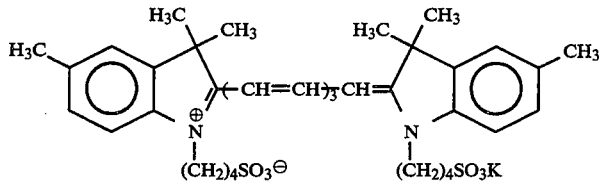

The master plate thus obtained was once passed through an etching machine using ELP-EX, and then immersed in the following oil-desensitizing solution E-3 for the binder resins of the photoconductive layer for 3 minutes, washed with water and dried.

| Preparation of Oil-desensitizing Solution E-3 | |
|---|---|
| Diethanolamine | 80 g |
| Neosoap (manufactured by Matsumoto Yushi KK) | 5 g |
| Methyl ethyl ketone | 80 g |

The above components were dissolved in distilled water to make a total volume of one liter, and pH was adjusted to 11.0 with potassium hydroxide.

The image area of the resulting printing plate was observed through an optical microscope and found to have no loss of fine lines and fine letters in the toner image portion, indicating good resistivity of the toner grain according to the present invention.

Then, the above-described plate was used as an offset master plate and evaluated for the printing durability in the same manner as described in Example 1 expect for using a solution prepared by 10-fold diluting the above Oil-desensitizing Solution E-3 with distilled water as dampening water. As a result, 3,000 sheets of prints having good printed image were obtained.

EXAMPLES 4 TO 15

Each of liquid developers was prepared in the same manner as described in Example 1 except that each of the latex grains shown Table 16 below was used in place of Latex Grain D-1 of the liquid developer according to the present invention.

TABLE 16

| Example | Latex Grain (D) |
|---|---|
| 4 | D-2 |
| 5 | D-3 |
| 6 | D-4 |
| 7 | D-9 |
| 8 | D-10 |
| 9 | D-13 |
| 10 | D-14 |
| 11 | D-15 |
| 12 | D-17 |
| 13 | D-19 |
| 14 | D-21 |
| 15 | D-27 |

Each of the resulting liquid developers was used in the electrophotographic plate-making system in the same manner as described in Example 1 to determine the performance thereof.

As a result, each of the liquid developers showed similar performance to that of Example 1 and had good redispersibility, fixing property, resistivity and printing durability.

EXAMPLES 16 TO 25

Each of liquid developers was prepared in the same manner as described in Example 2 expect that each of the latex grains shown in Table 17 below was used in place of Latex Grain D-22 of the liquid developer according to the present invention.

TABLE 17

| Example | Latex Grain (D) |
|---|---|
| 16 | D-24 |
| 17 | D-26 |
| 18 | D-28 |
| 19 | D-21 |
| 20 | D-23 |
| 21 | D-25 |
| 22 | D-27 |
| 23 | D-12 |
| 24 | D-13 |
| 25 | D-18 |

Each of the resulting liquid developers was used in the electrophotographic plate-making system in the same manner as described in Example 2 to determine the performance thereof.

As a result, each of the liquid developers showed similar performance to that of Example 2 and had good redispersibility, fixing property, resistivity and printing durability.

EXAMPLE 26

A mixture of 100 g of the white resin dispersion (Latex Grain D-29) obtained in Production Example 29 of Latex Grain and 1.5 g of Sumikalon black was heated to 100° C. and stirred for 4 hours at that temperature. After cooling to room temperature, the reaction mixture was passed through a 200 mesh nylon cloth to remove the remaining dye, whereby a black resin dispersion having a mean grain diameter of 0.21 μm was obtained.

Then, a liquid developer was prepared by diluting 30 g of the above-prepared black resin dispersion, and 0.05 g of zirconium naphthenate with one liter of Shellsol 71.

When the liquid developer was applied to the same developing apparatus as in Example 1 for making printing plates, no occurrence of stains of the developing apparatus by sticking of the toner was observed even after developing 2,000 plates.

Also, the quantity of the offset printing master plate obtained was clear and also the image quality of the 3,000 prints formed using the master plate was very clear.

EXAMPLE 27

A mixture of 100 g of the white dispersion (Latex Grain D-28) obtained in Production Example 28 of Latex Grain and 3 g of Victoria Blue B was heated to a temperature of from 70° C. to 80° C. with stirring for 6 hours. After cooling to room temperature, the reaction mixture was passed through a 200 mesh nylon cloth to remove the remaining dye, whereby a blue resin dispersion having a mean grain diameter of 0.25 μm was obtained.

Then, a liquid developer was prepared by diluting 32 g of the above-prepared blue resin dispersion, and 0.05 g of zirconium naphthenate with one liter of Isopar H.

When the liquid developer was applied to the same developing apparatus as in Example 3 for making printing plates, no occurrence of stains of the developing apparatus by sticking of the toner was observed even after developing 2,000 plates. Also, the image quality of the images on the offset printing master plate obtained was clear and also the image quality of the 3,000th print was very clear.

EXAMPLE 28

In a paint shaker (manufactured by Tokyo Seiki K.K.) were placed 10 g of a dodecyl methacrylate/acrylic acid copolymer (95/5 by weight ratio), 10 g of nigrosine, and 30 g of Isopar G together with glass beads and they were dispersed for 4 hours to obtain a fine dispersion of nigrosine.

Then, a liquid developer for electrostatic photography was prepared by diluting 30 g of Latex Grain D-101 obtained in Production Example 101 of Latex Grain, 2.5 g of the above-prepared nigrosine dispersion, 15 g of branched chain octadecyl alcohol, FOC-1800 (trade name, made by Nissan Chemical Industries, Ltd.) and 0.07 g of an octadecene-octadecylamide semi-maleate copolymer with one liter of Isopar G.

Comparative Liquid Developers A-2 to C-2

Three kinds of comparative liquid developers A-2 to C-2 were prepared in the same manner as above except that each of the resin dispersions (latex grains) shown below was used in place of Latex Grain D-101 used above.

Comparative Liquid Developer A-2

The latex grains obtained in Production Example 130 of Latex Grain were used.

Comparative Liquid Developer B-2

The latex grains obtained in Production Example 131 of Latex Grain were used.

Comparative Liquid Developer C-2

The latex grains obtained in Production Example 132 of Latex Grain were used.

These liquid developers were used for electrophotographic plate-making system to evaluate various characteristics. The results obtained are shown in Table 19 below.

The characteristic items described in Table 18 were evaluated in the same manner as described in Example 1.

TABLE 18

| | Example 28 | Comparative Example A-2 | Comparative Example B-2 | Comparative Example C-2 |
|---|---|---|---|---|
| Stain of Developing Apparatus | No toner residue adhered | No toner residue adhered | No toner residue adhered | No toner residue adhered |
| Image of the 2,000th Plate | Clear | Clear | Clear | Clear |
| Fixing Property of Image | Good | Good | Good | Good |
| Resistivity of Toner Image | Good | Fine lines and letter part lost | Fine lines and letter part lost | Fine lines and letter part lost |
| Printing Durability | 5,000 sheets | Poor from the start of printing | Poor from the start of printing | Poor from the start of printing |

As is noted from the results shown in Table 18, the liquid developers of the present invention, and Comparative Examples A-2 to C-2 showed good results without causing stains of the developing apparatus and providing clear images, which indicate good dispersibility and redispersibility of resin grains.

Also, when the mechanical strength of toner images was evaluated by subjecting the toner images to forced abrasion, each of the toner grains was found to be good condition. That is, the grain of the present invention was found to have practically sufficient fixing property.

Further, the plate was tested under forced conditions to determine whether the image areas were sufficiently resisted by the toner layer and whether the image area were not damaged when zinc oxide and the binder resin B-1 in the non-image areas were chemically treated to render the non-image areas hydrophilic. As a result, it was found that the toner grains other than that of the present invention were lost in fine parts of the toner image areas such as fine lines and fine letters.

Also, when the plate was processed under conventional oil-desensitizing treatment conditions and was then used for printing as an offset master plate, only the plate developed with the liquid developer according to the present invention provided clear prints even after printing 5,000 prints.

On the other hand, with the developers of Comparative Examples A-2 to C-2, the decreased reproducibility of the duplicated image during the plate-making also appeared in prints, and failures of fine lines and fine letters occurred from the start of printing.

The above results indicate that only the liquid developers according to the present invention provide excellent dispersibility, redispersibility and printing durability in the electrophotographic plate-making system utilizing an electrophotographic light-sensitive material having an improved printing properties.

EXAMPLE 29

A liquid developer for electrostatic photography was prepared by diluting 30 g of Latex Grain D-122 prepared in Production Example 122 of Latex Grain, 10 g of branched hexadecyl alcohol, FOC-1600 (trade name, made by Nissan Chemical Industries, Ltd.) and 0.06 g of an octadecylvinyl ether/dodecylamide semi-maleate copolymer with one liter of Isopar G.

Comparative Liquid Developers D-2 and E-2

Two kinds of Comparative Liquid Developers D-2 and E-2 were prepared in the same manner as above except that each of the resin dispersions (latex grains) shown below was used in place of Latex Grain D-122 used above.

Comparative Liquid Developer D-2

The latex grains obtained in Production Example 130 of Latex Grain were used.

Comparative Liquid Developer E-2

The latex grains obtained in Production Example 131 of Latex Grain were used.

These liquid developers were used for electrophotographic plate-making system to evaluate various characteristics. The results obtained are shown in Table 19 below.

In Table 19, the characteristic items of stains of developing apparatus and image of the 2,000th plate were evaluated in the same manner as described in Example 28, and other characteristic items were evaluated in the same manner as described in Example 2.

TABLE 19

| | Example 29 | Comparative Example D-2 | Comparative Example E-2 |
|---|---|---|---|
| Stain of Developing Apparatus | No toner residue adhered | No toner residue adhered | No toner residue adhered |
| Image of the 2,000th Plate | Clear | Clear | Clear |
| Resistivity of Toner Image | Good | Fine lines and letter part lost (dissolved out) | Fine lines and letter part lost (dissolved out) |
| Printing Durability | More than 100,000 sheets | Fine lines and letter part lost from the start of printing | Fine lines and letter part lost from the start of printing |

As is noted from the results shown in Table 19, the liquid developers of the present invention and Comparative Developers D-2 and E-2 showed good re-dispersibility and good image on the plate after printing 2,000 sheets.

Then, the plate obtained after plate-making was treated with an alkaline processing solution to dissolve out the non-image area to obtain a master plate for offset printing. At this point of time, Comparative Examples D-2 and E-2 showed loss of a small area portion of the toner image such as fine lines and fine letters. This indicates that the resistivity of the toner layer to the processing solution is not sufficient whereby the image area is dissolved out during the processing. On the other hand, with the developer of the present invention, the above adverse effect was not observed and showed sufficient resistivity.

Further, when the plate was used for printing as an offset master, the plate developed with a developer according to the present invention provided prints having a clear image even after printing 100,000 sheets. However, with Comparative Examples D-2 and E-2, the image of prints was deteriorated from the start of printing, and prints having a satisfactory image could not be obtained, since Comparative Examples D-2 and E-2 did not provide sufficient resistivity to the processing solution for dissolving out the non-image area and, thus, these developers did not provide image reproducibility sufficient for an offset master plate.

The above results indicate that only the liquid developers according to the present invention provide satisfactory dispersibility, redispersibility and printing durability in the electrophotographic plate-making system wherein the printing plate is prepared by dissolving out the non-image area of the electrophotographic light-sensitive material.

EXAMPLE 30

In a paint shaker (manufactured by Tokyo Seiki K.K.) were placed 10 g of a copolymer of tetradecyl methacrylate/acrylic acid (95/5 by weight ratio), 10 g of nigrosine, and 30 g of Isopar G together with glass beads followed by dispersing for 4 hours to obtain a fine dispersion of nigrosine.

Then, a liquid developer for electrostatic photography was prepared by diluting 30 g of Latex Grain D-123 obtained in Production Example 123 of Latex Grain, 2.5 g of the above-prepared nigrosine dispersion, 0.06 g of a copolymer of hexadecene and octadecylamide semimaleate and 20 g of FOC-1800 (trade name of octadecyl alcohol, made by Nissan Chemical Industries, Ltd.), with one liter of Isopar G.

The resulting liquid developer of the present invention was evaluated for the stains of the developing apparatus and the image of the 2,000 plate under the same conditions as in 1) of Example 1, and good results similar to those of Example 28 were obtained.

Then, the electrophotographic light-sensitive material P-3 used in Example 3 above was charged to −6 kV in a dark place. The plate was then exposed at a pitch of 25 μm and a scanning speed of 330 m/sec under irradiation of 45 erg/cm$^2$ on the surface of the light-sensitive material using a gallium-aluminum-arsenic semiconductor laser (oscillation wavelength: 780 nm) with an output of 2.0 mW as a light source, and developed with the liquid developer of the present invention. The plate was then heated at 60° C. for 30 seconds to obtain a toner image.

The master plate thus obtained was once passed through an etching machine using ELP-EX, and then immersed in the oil-desensitizing solution E-3 for the binder resins of the photoconductive layer prepared in Example 3, washed with water and dried.

The image area of the resulting printing plate was observed through an optical microscope and found to have no loss of fine lines and fine letters in the toner image portion, indicating good resistivity of the toner grain according to the present invention.

Then, the above-described plate was used as an offset master plate and evaluated for the printing durability in the same manner as described in Example 28 expect for using a solution prepared by 10-fold diluting the Oil-desensitizing Solution E-3 prepared in Example 3 with distilled water as dampening water. As a result, 3,000 sheets of prints having good printed image were obtained.

EXAMPLES 31 TO 42

Each of liquid developers was prepared in the same manner as described in Example 28 except that each of the latex grains shown Table 20 below was used in place of Latex Grain D-101 of the liquid developer according to the present invention.

TABLE 20

| Example | Latex Grain (D) |
|---|---|
| 31 | D-102 |
| 32 | D-103 |
| 33 | D-104 |
| 34 | D-105 |
| 35 | D-110 |
| 36 | D-112 |
| 37 | D-113 |
| 38 | D-114 |
| 39 | D-118 |

TABLE 20-continued

| Example | Latex Grain (D) |
|---|---|
| 40 | D-119 |
| 41 | D-120 |
| 42 | D-124 |

Each of the resulting liquid developers was used in the electrophotographic plate-making system in the same manner as described in Example 28 to determine the performance thereof.

As a result, each of the liquid developers showed similar performance to that of Example 28 and had good redispersibility, fixing property, resistivity and printing durability.

EXAMPLES 43 TO 52

Each of liquid developers was prepared in the same manner as described in Example 29 expect that each of the latex grains shown in Table 21 below was used in place of Latex Grain D-122 of the liquid developer according to the present invention.

TABLE 21

| Example | Latex Grain (D) |
|---|---|
| 43 | D-115 |
| 44 | D-123 |
| 45 | D-125 |
| 46 | D-126 |
| 47 | D-106 |
| 48 | D-108 |
| 49 | D-129 |
| 50 | D-117 |
| 51 | D-121 |
| 52 | D-109 |

Each of the resulting liquid developers was used in the electrophotographic plate-making system in the same manner as described in Example 29 to determine the performance thereof.

As a result, each of the liquid developers showed similar performance to that of Example 29 and had good redispersibility, fixing property, resistivity and printing durability.

EXAMPLE 53

A mixture of 100 g of the white resin dispersion (Latex Grain D-128) obtained in Production Example 128 of Latex Grain and 1.5 g of Sumikalon black was heated to 100° C. and stirred for 4 hours at that temperature. After cooling to room temperature, the reaction mixture was passed through a 200 mesh nylon cloth to remove the remaining dye, whereby a black resin dispersion having a mean grain diameter of 0.21 μm was obtained.

Then, a liquid developer was prepared by diluting 30 g of the above-prepared black resin dispersion, and 0.05 g of zirconium naphthenate with one liter of Shellsol 71.

When the liquid developer was applied to the same developing apparatus as in Example 28 for making printing plates, no occurrence of stains of the developing apparatus by sticking of the toner was observed even after developing 2,000 plates.

Also, the quantity of the offset printing master plate obtained was clear and also the image quality of the 3,000th print printed using the master plate was very clear.

EXAMPLE 54

A mixture of 100 g of the white dispersion (Latex Grain D-27) obtained in Production Example 127 of Latex Grain and 3 g of Victoria Blue B was heated to a temperature of from 70° C. to 80° C. with stirring for 6 hours. After cooling to room temperature, the reaction mixture was passed through a 200 mesh nylon cloth to remove the remaining dye, whereby a blue resin dispersion having a mean grain diameter of 0.25 μm was obtained.

Then, a liquid developer was prepared by diluting 32 g of the above-prepared blue resin dispersion, and 0.05 g of zirconium naphthenate with one liter of Isopar H.

When the liquid developer was applied to the same developing apparatus as in Example 30 for making printing plates, no occurrence of stains of the developing apparatus by sticking of the toner was observed even after developing 2,000 plates. Also, the image quantity of the images on the offset printing master plate obtained was clear and also the image quality of the 3,000th print was very clear.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising at least resin grains dispersed in a non-aqueous solvent having an electric resistance of at least $10^9$ Ωcm and a dielectric constant of not higher than 3.5, wherein the dispersed resin grains are polymer resin grains obtained by polymerizing a solution containing (1) at least one monofunctional monomer (A) which is soluble in the non-aqueous solvent but becomes insoluble therein by being polymerized, (2) at least one monofunctional macromonomer (MA) having a number average molecular weight of not more than $1\times10^4$ and having a polymerizable double bond group represented by the general formula (II) shown below bonded to only one terminal of the main chain of a polymer composed of a repeating unit represented by the general formula (I) shown below, or at least one oligomer (B) having a number average molecular weight of not more than $1\times10^4$ and having at least one polar group selected from a carboxy group, a sulfo group, a hydroxy group, a formyl group, an amino group, a phosphono group and

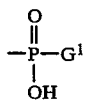

(wherein $G^1$ represents a hydrocarbon group or $—OG^2$ (wherein $G^2$ represents a hydrocarbon group) bonded to only one terminal of the main chain of a polymer composed of a repeating unit represented by the general formula (I) shown below, (3) at least one polyfunctional monomer (D) having at least two polymerizable functional groups which are copolymerizable with the monofunctional monomer (A), and (4) at least one dispersion-stabilizing resin (P) soluble in the non-aqueous solvent, which is a polymer containing a repeating unit represented by the general formula (III) shown below and the main chain of the polymer is partially cross-linked;

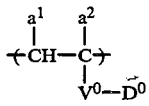

(I)

wherein $V^0$ represents —COO—, —OCO—, $-(CH_2)_r-COO-$, $-CH_2)_rOCO-$, —O—, $-SO_2-$, —CONHCOO—, CONHCONH—,

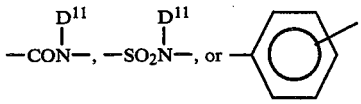

(wherein $D^{11}$ represents a hydrogen atom or a hydrocarbon group having from 1 to 22 carbon atoms; and r represents an integer of from 1 to 4); $a^1$ and $a^2$, which may be the same or different, each represents a hydrogen atom, a halogen atom, a cyano group, a hydrocarbon group, —COO—$D^{12}$, or —COO—$D^{12}$ bonded via a hydrocarbon group (wherein $D^{12}$ represents a hydrogen atom or a hydrocarbon group); and $D^O$ represents a hydrocarbon group having from 1 to 22 carbon atoms or a substituent selected from the substituents represented by the following general formula (IV):

$$-(A^1-B^1)_m(A^2-B^2)_nD^{21} \quad \text{(IV)}$$

wherein $D^{21}$ represents a hydrogen atom or a hydrocarbon group having from 1 to 22 carbon atoms; $B^1$ and $B^2$, which may be the same different, each represents —O—, —CO—, $-CO_2-$, —OCO—, $-SO_2-$,

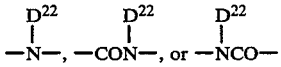

(wherein $D^{22}$ has the same meaning as $D^{21}$ defined above%; $A^1$ and $A^2$, which may be the same or different, each represents a hydrocarbon group having from 1 to 18 carbon atoms which may be substituted and which may contain an intervening group represented by the following formula in the main chain of the hydrocarbon group;

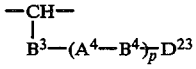

(wherein $B^3$ and $B^4$, which may be the same or different, each has the same meaning as $B^1$ and $B^2$; $A^4$ represents a hydrocarbon group having from 1 to 18 carbon atoms; and $D^{23}$ has the same meaning as $D^{21}$ defined above); m, n and p, which may be the same or different, each represents an integer of from 0 to 4, provided that m, n and p cannot be 0 at the same time;

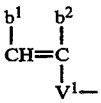

(II)

wherein $V^1$ has the same meaning as $V^0$ defined in the general formula (I); and $b^1$ and $b^2$, which may be the same or different, each has the same meaning as $a^1$ or $a^2$ defined in the general formula (I);

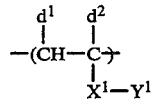

(III)

wherein $X^1$ represents —COO—, —OCO—, $-CH_2OCO-$, $-CH_2COO-$, —O— or $-SO_2-$; $y^1$ represents an aliphatic group having from 6 to 32 carbon atoms; and $d^1$ and $d^2$, which may be the same or different, each represents a hydrogen atom, a halogen atom, a cyano group, a hydrocarbon group having from 1 to 8 carbon atoms, —COO—$Z^1$ or —COO—$Z^1$ bonded via a hydrocarbon group having from 1 to 8 carbon atoms (wherein $Z^1$ represents a hydrocarbon group having from 1 to 22 carbon atoms).

2. A liquid developer for electrostatic photography as claimed in claim 1, wherein the content of the repeating unit represented by the general formula (I) in the macromonomer (MA) is at least 40% by weight of the total repeating units present therein.

3. A liquid developer for electrostatic photography as claimed in claim 1, wherein the content of the repeating unit represented by the general formula (I) in the oligomer (B) is at least 40% by weight of the total repeating units present therein.

4. A liquid developer for electrostatic photography as claimed in claim 1, wherein the polyfunctional monomer (D) is used in an amount of not more than 20% by weight of the total monomers used.

5. A liquid developer for electrostatic photography as claimed in claim 1, wherein the content of the repeating unit represented by the general formula (III) in the dispersion-stabilizing resin (P) is at least 30% by weight of the total repeating unit present therein.

6. A liquid developer for electrostatic photography as claimed in claim 1, wherein the dispersion-stabilizing resin (P) contains at least one polar group selected from $-PO_3H_2$, $-SO_3H$, —COOH,

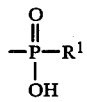

wherein $R^1$ represents a hydrocarbon group or $-OR^2$ (wherein $R^2$ represents a hydrocarbon group), —OH, a formyl group,

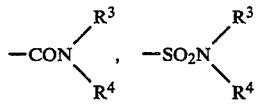

(wherein $R^3$ and $R^4$ each represents a hydrogen atom or a hydrocarbon group), a cyclic acid anhydride-containing group and an amino group, at one terminal of the main chain thereof.

7. A liquid developer for electrostatic photography as claimed in claim 1, wherein the dispersion-stabilizing resin (P) contains a polymerizable functional group which is copolymerizable with the monomer (A), at one terminal of the main chain thereof.

8. A liquid developer for electrostatic photography as claimed in claim 1, wherein the dispersion stabilizing resin (P) has a weight average molecular weight of from $1\times10^4$ to $1\times10^6$.

9. A liquid developer for electrostatic photography as claimed in claim 1, wherein the dispersion-stabilizing resin is used in an amount of from 1 to 100 parts by weight per 100 parts by weight of the total monomer used.

10. A liquid developer for electrostatic photography as claimed in claim 1, wherein the monofunctional monomer (A) is represented by the following general formula (V):

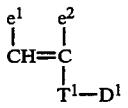

(V)

wherein $R^1$ represents —COO—, —OCO—, —$CH_2$OCO—, —$CH_2$COO—, —O—, —CONHCOO—, —CONHOCO—, —$SO_2$—,

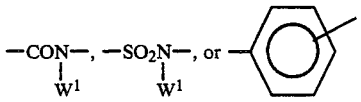

(wherein $W^1$ represents a hydrogen atom or an aliphatic group having from 1 to 8 carbon atoms which may be substituted), $D^1$ represents a hydrogen atom or an aliphatic group having form 1 to 6 carbon atoms, and $e^1$ and $e^2$ which may be the same or different, each represents a hydrogen atom, a halogen atom, a cyano group, a hydrocarbon group, —COO—$D^{12}$ or —COO—$D^{12}$ bonded via a hydrocarbon group (wherein $D^{12}$ represents a hydrocarbon group) .

11. A liquid developer for electrostatic photography as claimed in claim 1, wherein the liquid developer further contains a coloring agent.

* * * * *